US011262171B1

(12) United States Patent
Viggiano et al.

(10) Patent No.: US 11,262,171 B1
(45) Date of Patent: Mar. 1, 2022

(54) FIREARM CASING HAVING A CURVED-CONTOUR CANNELURE

(71) Applicant: Shell Shock Technologies LLC, Westport, CT (US)

(72) Inventors: Anthony Viggiano, Groton, CT (US); Volodymyr Drobockyi, Hebron, CT (US)

(73) Assignee: SHELL SHOCK TECHNOLOGIES LLC, Westport, CT (US)

( * ) Notice: Subject to any disclaimer, the term of this patent is extended or adjusted under 35 U.S.C. 154(b) by 0 days.

(21) Appl. No.: 16/916,825

(22) Filed: Jun. 30, 2020

Related U.S. Application Data

(63) Continuation of application No. 16/383,633, filed on Apr. 14, 2019, now Pat. No. 10,697,743, which is a continuation-in-part of application No. 15/221,530, filed on Jul. 27, 2016, now Pat. No. 10,260,847.

(51) Int. Cl.
*F42B 5/285* (2006.01)
*F42C 19/08* (2006.01)

(52) U.S. Cl.
CPC ..... *F42B 5/285* (2013.01); *F42C 19/0807* (2013.01)

(58) Field of Classification Search
CPC ..... F42B 5/285; F42B 5/292; F42B 5/295; F42B 5/297; F42B 5/307; F42B 5/313; F42B 33/001; F42B 33/0207; F42B 33/04; F42C 19/0823; F42C 19/0826; F42C 19/083; F42C 19/10
USPC ..... 102/464–470, 204; 86/12, 18, 19.5, 19.8
See application file for complete search history.

(56) References Cited

U.S. PATENT DOCUMENTS

| | | | | | |
|---|---|---|---|---|---|
| 43,851 | A * | 8/1864 | Howe | F42B 5/26 | 102/464 |
| 2,904,873 | A * | 9/1959 | Hild | F42B 5/28 | 86/19.6 |
| 3,874,294 | A * | 4/1975 | Hale | F42B 33/001 | 102/467 |
| 4,041,868 | A * | 8/1977 | Rayle | F42B 5/28 | 102/468 |
| 4,122,933 | A * | 10/1978 | Starzyk | B65G 11/203 | 193/32 |
| 9,939,236 | B2 * | 4/2018 | Drobockyi | F42B 33/001 | |
| 10,260,847 | B2 * | 4/2019 | Viggiano | F42B 33/04 | |

(Continued)

OTHER PUBLICATIONS

PCT International Search Report, Application PCT/US19/27420, dated Sep. 3, 2019, 20 pages.

*Primary Examiner* — Bret Hayes
(74) *Attorney, Agent, or Firm* — C. Nessler

(57) ABSTRACT

A casing for use in a cartridge for a firearm comprises a sleeve portion and a base portion, where the base has cannelure comprised of curving surfaces. In a casing embodiment, a sleeve has cylindrical portion with a mouth for holding a bullet and an opposing end radially-running bulkhead. A nipple extends from the bulkhead and into a passageway of the base, thereby securing the sleeve to the base. The sleeve bulkhead preferably has at least one circumferential wave and contacts a distal end surface of the base, which may be planar or conical. The cannelure is characterized by a continuously curving groove bottom, a maximum groove depth diameter that is 60 to 80 percent of the base outside diameter, and a volume that is 20 to 43 percent of the volume of a like base which has no cannelure.

16 Claims, 10 Drawing Sheets

(56) References Cited

U.S. PATENT DOCUMENTS

| | | | | |
|---|---|---|---|---|
| 2006/0075919 | A1* | 4/2006 | Wiley | F42B 5/26 102/464 |
| 2017/0030690 | A1* | 2/2017 | Viggiano | F42C 19/0807 |
| 2017/0030692 | A1* | 2/2017 | Drobockyi | F42B 33/001 |
| 2018/0321020 | A1* | 11/2018 | Evans | F42B 5/285 |

* cited by examiner

20

FIREARM CASING HAVING A CURVED-CONTOUR CANNELURE

This application is a divisional application of application Ser. No. 16/383,633, filed Apr. 14, 2019, now U.S. Pat. No. 10,697,774, which is a continuation in part of application Ser. No. 15/221,530 filed Jul. 27, 2016, now U.S. Pat. No. 10,260,847.

TECHNICAL FIELD

The present invention relates to cartridges for firearms, in particular to casings for ammunition.

BACKGROUND

In the field of firearms, ammunition cartridges (also called ammunition shells and "rounds") contain powder, which when ignited propels a bullet down the barrel of a gun toward a target. Prior art cartridges, particularly those for use with small arms, typically comprise a casing made of forged brass. A propellant, typically smokeless explosive powder, is contained within the casing and is ignited by impact of a firing pin of the breech block of the gun on a primer that is set in a recess at the base of the casing.

A cartridge relevant to the present invention comprises a generally cylindrical casing having a substantially closed end, called here the base end, and an opposing open end, often called the mouth. The open end of the mouth receives a bullet after propellant is put into the concavity of the casing; and the casing is crimped as needed around the bullet to hold it in place. The base end of the casing typically has a cannelure or groove to enable the casing to be engaged by grips on the firing mechanism of a gun. The base end often comprises a larger diameter flange portion which acts as a stop, limiting the depth of insertion of the cartridge into the chamber of the barrel of the gun.

In prior art cartridges comprised of forged metal (typically cartridge brass) casings, the base end which holds the primer is integral with the sleeve portion which holds the bullet. Typically, the sleeve is tapered internally (with the larger diameter at the open end), attributable to the metal-working process by which the cartridge is formed. The wall thickness near the base may is as several times the thickness of the wall at the mouth end. Sometimes a casing has a step-down in diameter in vicinity of the open end, where the bullet is captured.

The exterior surface of the base of the typical cartridge has a recess within which is contained a percussion primer that contains a small quantity of impact-sensitive explosive powder. Typically, the primer is in the center of the base and comprises an internal anvil which is supported during the firing process by the end of the recess. There is a small passageway through the base, often called the vent or flash hole, enabling ignited primer gases to pass through the base and into the concavity of the casing, to ignite the propellant.

A cartridge necessarily slip-fits into a chamber of the barrel of the gun for which it is intended. A cartridge is typically inserted and held in place by the breech block (also called slide or bolt) which usually has one or more claws for grasping the groove in the rim of the base of the casing. When the primer is struck by the firing pin within the breech block of the gun, the propellant explosively turns into gas and forces the bullet from the cartridge and down the bore of the barrel of the gun. In that process, the pressure of the deflagrated propellant gas expands the casing of the cartridge radially outwardly, desirably creating a seal against gas escape through the slip fit clearance region of the casing with the chamber. Then the casing hopefully relaxes, moving radially inwardly to about its original dimension, enabling the casing of the spent cartridge to be readily removed. A casing is often removed from the chamber by retracting action of the breech block which pulls on the cannelure; or by force of the pressurized gases on the casing in coordination with rearward motion of the breech block. After ejection from the breech area, a casing may often be recycled by replacing the primer and powder and installing a new bullet.

There are differences in peak deflagration pressures that occur during firing of a cartridge, according the size of the cartridge and the volume of gunpowder it holds. Peak pressures, e.g., 20,000-30,000 pounds per square inch (psi), are typically encountered in cartridges firing bullets in handguns. A 9 mm pistol cartridge is an example. Comparatively high pressures, for e.g., 40,000-60,000 psi can be encountered in cartridges firing bullets in rifles, particularly military rifles. A 7.62 mm rifle cartridge is an example.

Good cartridges have a number of desired characteristics, with the ranking determined by a particular customer and application. Generally stated, cartridges and casings desirably have the following features. They should be strong enough to resist fracture or distortion which causes jamming, when subjected to the pressure of deflagration gases as just discussed. They should be configured for making a seal with the chamber of the gun during firing of a bullet; and they should be readily extractable from the chamber. They should have general durability and integrity, including the ability to resist possible rough handling prior to placement in a firearm and the ability to be reworked and reloaded. They should be corrosion resistant. Traditionally, cartridges of brass alloys had worked well. Further, particularly for military applications there is a desire for a casing that is as light as possible particularly when quantities of cartridges are carried by an aircraft or by a soldier.

The brass of common and widely used traditional casings is a costly alloy compared to various iron and aluminum alloys, and of course, compared to plastic. However, alternative materials such as steels, aluminum alloys and plastics have found less favor in the marketplace, usually due to perceived deficiencies in the characteristics above.

Other inventors have described a variety of alternative constructions and materials for cartridges. For example: Cartridges may be made in whole or part from plastics and metals other than brass. The casing may be made of plastic or paper and attached to a metal base (as is common for shotgun shells). The casing may be made in the form of a sleeve having a nipple end which is inserted into a passageway in a base that runs to a primer, and the nipple is flared radially, to hold the two parts together. For reference see the following publications: Milbank U.S. Pat. No. 125,830; Horn U.S. Pat. No. 3,688,699; Skochko U.S. Pat. No. 3,765,297; Anderson U.S. Pat. No. 3,977,326; Horn U.S. Pat. No. 3,688,699; Dittrich U.S. Patent Publications 2007/0214992 and 2008091245, and Neugebauer U.S. Patent Publication 2014/0224144. Based on the absence from the marketplace for most if not all of the foregoing kinds of casings and cartridges, it would appear further improvements are needed.

Further desirable characteristics of casings include the following: For economic and environmental reasons, spent casings that are expelled from a gun after firing will be amenable to being readily gathered up; when casings are made of brass or plastic that basically means using visual or optical means. Also, for economic and environmental reasons, a casing will be able to be re-used; but the construction of many prior art casings does not lend itself to one or more re-uses. There is always a desire for a lower cost cartridge, particularly for small arms cartridges that are used in large quantities. And there is always a continuing desire to improve the performance of cartridges. For example, for any particular caliber of cartridge it is generally desirable to maximize the volume within which gunpowder is contained.

SUMMARY

An object of the invention is to provide a cartridge use in a firearm, which is improved with respect to being light in weight and economic to manufacture, corrosion resistant, resistant to damage in handling, accommodative of primers currently in use, and suited for re-loading after use. A further object is to have a cartridge comprised of a casing which is attracted by a magnet to enable improvement in such gathering of spent casings. An object of the present invention is to make a lower cost cartridge, particularly for small arms, which is equal or better than prior art cartridges.

In embodiments of the invention, a cartridge for a firearm comprises a casing. In one embodiment, a casing comprises a sleeve which is secured to a base by means of a hollow nipple that extends from a bulkhead at one end of the sleeve and that is fastened in a passageway through the base. The opposing lengthwise end of the sleeve is cylindrical and comprises a mouth for holding a bullet or other closure. A recess in the passageway receives a primer. The bulkhead of the sleeve contacts or is intimately disposed at the first surface of the base. The terminal end of the nipple flares as a lip that sealingly engages a shoulder of the recess. In a casing embodiment there are two seals within the passageway, along the length of the nipple, one near the bulkhead and one at the lip/shoulder; and the seals are spaced apart by a tapered cylindrical void space around the nipple.

In another embodiment of the invention, the terminal end of the nipple which comprises a lip has, in casing lengthwise cross section, a special shape: (a) a first side of the lip is in contact with the shoulder, which is preferably runs at 90 degrees to the casing length; and (b) a second side (that faces the primer) is contoured and thinner at the lip outer rim than nearer the passageway (flash hole) through the nipple. The second side of the lip is contacted by the legs of the anvil of the primer in an advantageous way and enables an increased diameter of flash hole.

In other embodiments of the invention, the bulkhead has one or more depressions on the side which mates with the end of the base, preferably there is one or more circular waves or ridges centered on the lengthwise axis and the nipple. The wave creates a depression or hollow, and thus a space between the bulkhead and the surface of the base when the bulkhead is in contact therewith; and the wave creates a raised region in the gunpowder-holding concavity of the sleeve. The bulkhead is un-restrained by the surface of the base; i.e. there is no interlock or fastener other than by means of the nipple. Thus, the wave enables the bulkhead to expand radially during the pressure transient associated with firing a bullet, so the outer surface of the sleeve can contact the bore of the chamber and so that there are lesser stresses than would otherwise be present, to cause premature failure.

Another casing embodiment has a base with a surface having the same diameter as the bulkhead that abuts it, and the cannelure is spaced apart from said base surface, also to lessen stresses and enable a thin wall in the sleeve. In other embodiments, for resisting the high pressures associated with certain rifle rounds, such as a 7.62 mm NATO round, the distal end of the base and the mating bulkhead of the sleeve both have conical portions, preferably with annular portions that are either, or both, adjacent the passageway/nipple and adjacent the cylindrical outer edge of the base. Optionally, there is a thin skirt around the edge of the base to provide support to the edge of the sleeve where the cylindrical sleeve surface meets the bulkhead.

In other embodiments, the cannelure of a base, particularly one made of steel and one preferably having the aforementioned conical feature, is substantially larger (deeper) than, and differently shaped from, a prior art cannelure. There is an annular surface at the cannelure end where an extraction arm grabs the casing; and there is a continuously curved surface extending in the lengthwise direction, to a location close to where the sleeve bulkhead is mated with the base. A cannelure embodiment has an innermost or groove-depth diameter DTT which is between about 60 and about 80 percent of the outside diameter DWW of the base, and a volume which is between about 20 and about 43 percent of the volume of a like-base which has no cannelure.

In another embodiment, the casing is made of an austenitic stainless steel having the special character of becoming magnetic when cold-worked. The sleeve has a cylindrical mouth wall portion of a first hardness and a first permeability, a bulkhead with a lesser hardness and permeability, and a nipple with a still lesser hardness and permeability. Thus, the lip which holds the sleeve fixed to the base can be more easily formed. The cylindrical part of the casing will be drawn to a magnet, sufficient thereby to facilitate retrieval of spent casings. And the base is preferably made of an aluminum alloy which has a hardness that is less than any part of the sleeve.

Different combinations of the foregoing embodiments are useful. The present invention also comprises the method of making a casing and a cartridge which have the desired features described above.

A cartridge having a casing of the present invention fulfills the objects of the invention. The casing is stronger than the prior art brass cartridge casings for which it is substitutional. A casing has increased volume that enables use of slower burning powder. A casing is exceptionally durable and resists fatigue failure. It can be reloaded and fired many more times than a conventional cartridge. The foregoing and other features and advantages will be fully appreciated from the more detail description which follows and associated drawings.

DESCRIPTION

Figure 1:
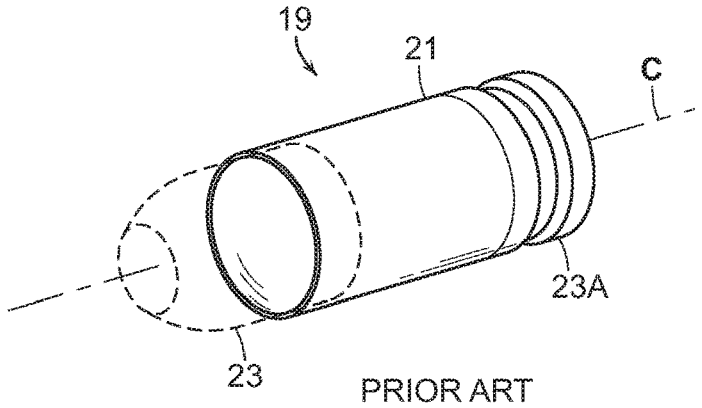
PRIOR ART FIG. 1
FIG. 1 is a perspective view of a typical prior art cartridge with the bullet shown in phantom.

FIG. 1 is a perspective view of a prior art casing 19 having a central length axis C; the casing comprises a cylindrical sleeve like portion 21 which is most often integral with base 23A. Sleeve 21 has an open end or mouth. A bullet 23, shown in phantom, is frictionally held at the mouth of the sleeve after propellant is put within the interior cavity of the casing. In a conventional 9 mm cartridge the bullet will set about 0.19 inches (4.8 mm) deep within the mouth end of the sleeve.

Figure 2:
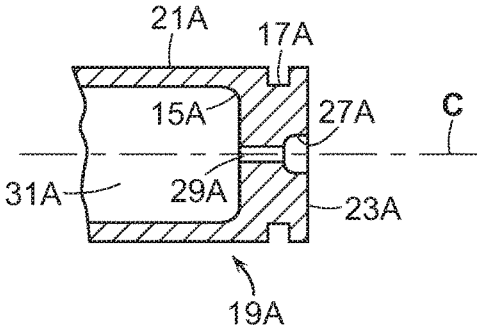
PRIOR ART FIG. 2
FIG. 2 is a partial cross section of the base end of a prior art casing.

FIG. 2 is a partial lengthwise cross section through the bottom end of a casing 19A, like those casings which are familiarly made from brass. Base portion 23A has a cylindrical recess 27A at the end, which is shaped to receive a primer that is press-fitted. Passageway 29A, often called the flash hole or vent, runs between the recess 27A and the interior concavity 31A of the sleeve of the casing. The sleeve portion 21A of casing 19A has a cylindrical outside surface wall that increases in thickness with distance from the mouth and with proximity to the base portion 23A. Such change in thickness is usually attributable to limitations of the fabrication process used; it also may be required to provide increased wall strength proximate the base portion, for resisting deformation or failure due to the high pressure generated inside the casing during firing of a bullet. Similarly, there is a rounded interior corner 15A where the cylindrical portion meets the base. Other projectiles and closures may be used for containing gunpowder in casings, for instance wadding may be used in a so-called blank round. In this description any closure of the casing mouth shall be within the scope of the term "bullet."

Figure 3:
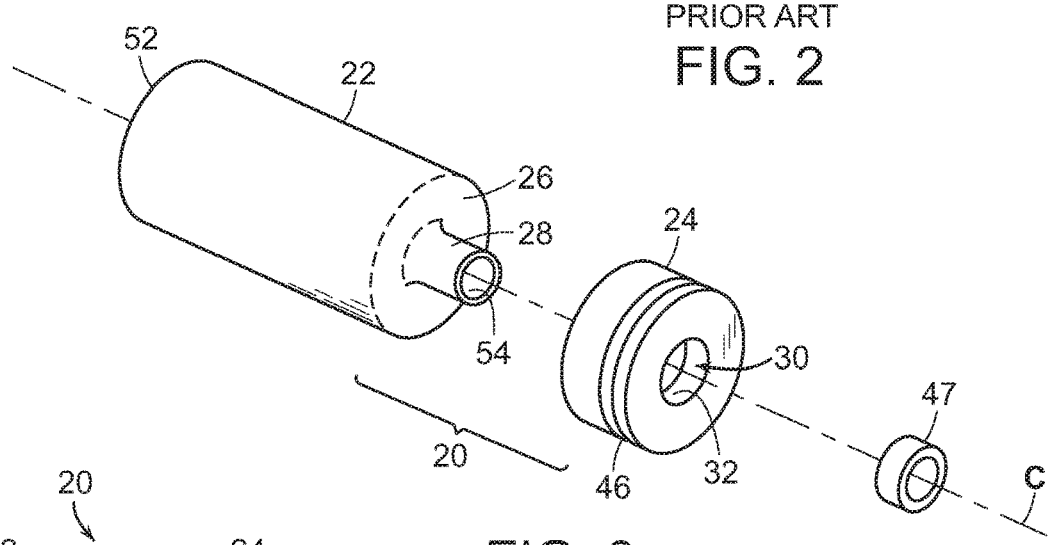
FIG. 3 is an exploded view of a casing of the present invention along with a primer.

FIG. 3 is an exploded view of an embodiment of casing 20 of the present invention, in combination with a primer 47. The casing is comprised of two mated pieces: sleeve 22 and base 24 centered on lengthwise axis C. Passageway 30 runs through the base to receive the nipple 28 of the sleeve. At the proximal end of the base the passageway has larger diameter, namely recess 32, to receive cylindrical primer 47 with a press-fit. Base 24 has a cannelure 46, also called an extraction groove, near the distal end.

Figure 4:
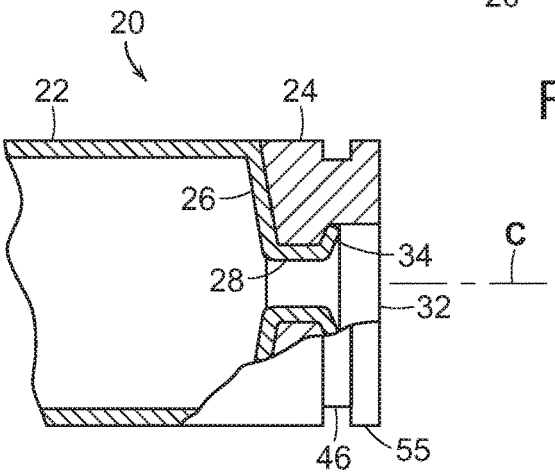
FIG. 4 is a cross section through an embodiment of the casing shown in FIG. 3.

FIG. 4 is a partial cutaway lengthwise view of an assembled casing 20 comprised of sleeve 22 which has been secured to base 24 by deformation of nipple 28 of the sleeve. Referring to both FIG. 3 and FIG. 4, before being mated with the base, sleeve 22 has an elongated cylindrical portion and a first end 52, shaped for receiving and holding a bullet. End 52 is often called the mouth of the casing. At the opposing end of the sleeve, nipple 28 extends from inward-running bulkhead 26. Except where stated otherwise, a preferred bulkhead runs inward at an angle which is nominally perpendicular to the lengthwise axis of the sleeve. It will be understood that limitations and variation in transfer-press metal forming process, used to make a sleeve, can result in small deviations from planarity and perpendicularity. As formed before mating with the base, nipple 28 has an open end 54. When the two parts 22, 24 are mated, so the nipple is within passageway 30, the open end of the nipple is flared outwardly to form lip 34 thereby to hold the sleeve to the base. The end of the base which faces the bulkhead of a sleeve is sometimes called the distal end of the base.

Some aspects of the present invention relate to the mechanical configurations of the casing and its components, where the materials do not necessarily have a desirable unique combination of properties. The mechanical configurations of invention embodiments include how the sleeve and base are each shaped and how they mate with each other. In brief: A sleeve has a nearly constant thickness cylindrical wall portion, a bulkhead portion which optionally has a wave (annular ridge), and the terminal end of the nipple flares outwardly within the base to form a lip, thereby holding the sleeve to the base. The lip has a surface shape that is suited to support the primer. The invention casing has superior interior volume compared to prior art casings of the same exterior size.

While cartridges and casings having the foregoing features can be made using various materials, embodiments of the present invention involve materials with special properties and combinations of properties. In brief: Embodiments of the present invention comprise a sleeve which is made of an austenitic stainless steel that is hardened and magnetic, and the base is made of a softer metal, such as aluminum base alloy.

The mechanical aspects of the invention are concentrated on first in the following description. A casing of the present invention may be made of different materials and combinations of materials. Preferably, as discussed in greater detail below, a sleeve is made of austenitic stainless steel having a martensitic microstructure and the base is a wrought aluminum alloy.

Figure 5:
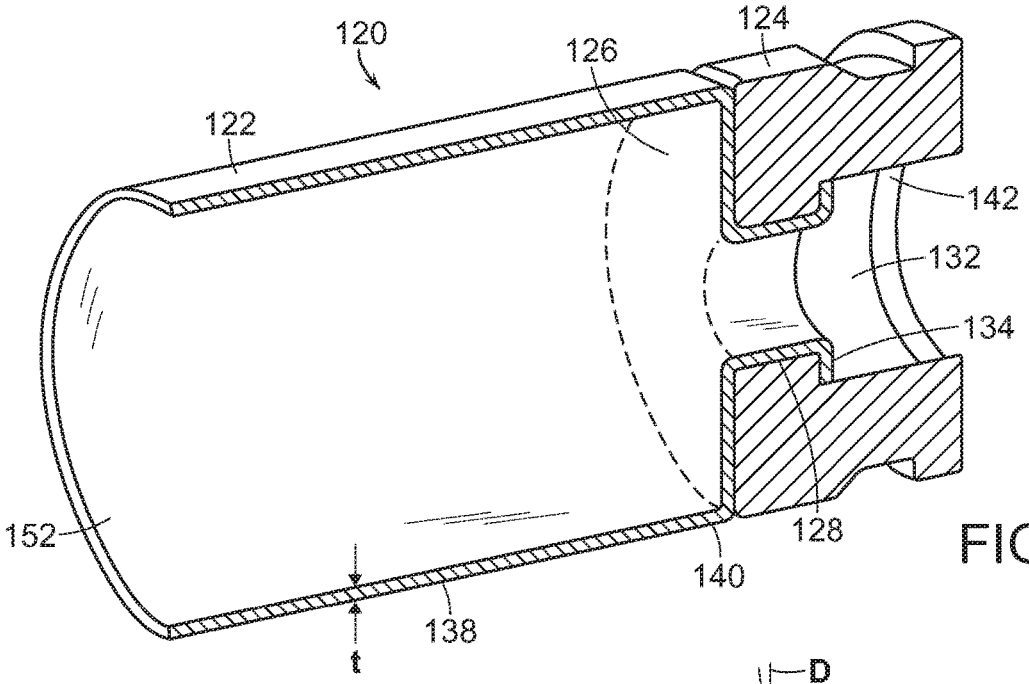
FIG. 5 is a lengthwise cross section through a casing.
Figure 6:
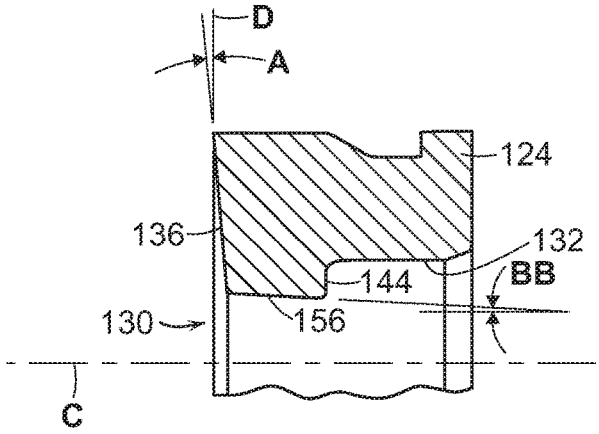
FIG. 6 is a more detail cross section view of the base shown in FIG. 5.
Figure 7:
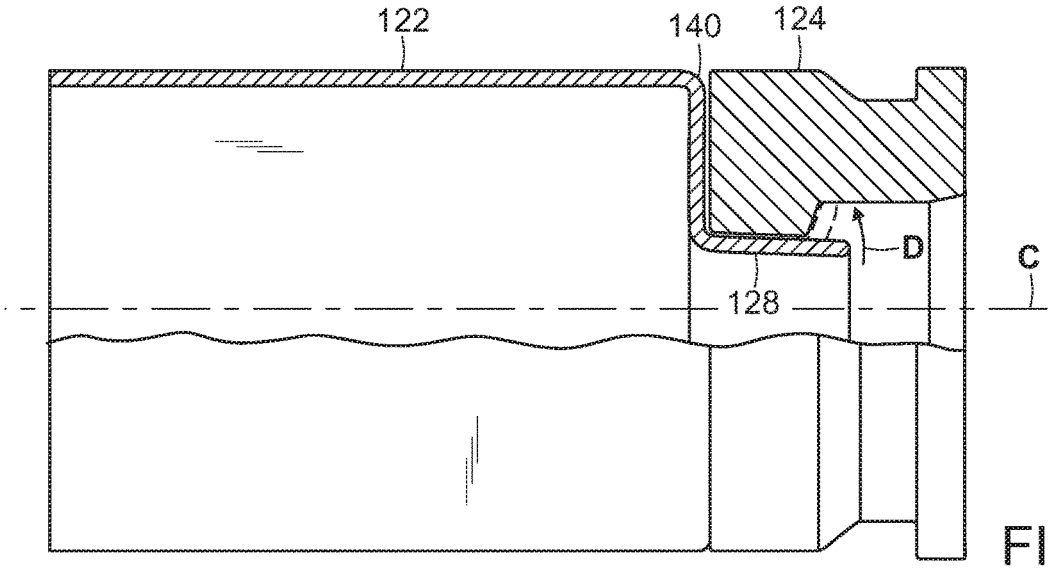
FIG. 7 is a partial lengthwise cross section through the casing of FIG. 5, showing how the sleeve is secured to the base.

FIG. 5 shows casing 120, comprised of a sleeve 122 and base 124, centered on lengthwise axis C. Sleeve 122 has an open end 152 for receiving a bullet, a cylindrical wall 138 having thickness t, and a bulkhead 126 which largely closes off the end of the sleeve which is proximate the surface of the base. Reference is also made to FIG. 6 and FIG. 7. Elements in different embodiments which have a number that shares the last two digits with another element number are same name and substantially same-function elements.

With reference to the partial cross section of base 124 in FIG. 6, the base has a circumferential land, or shoulder 144 where recess 132 of passageway 130 transitions to passageway 156. The surface of shoulder 144 is preferably perpendicular to the length axis C, optionally, inclined. The engagement of lip 134 with shoulder 144 helps hold the sleeve to the base and the lip forms a seal with the shoulder, to prevent or inhibit flow of gases from the primer region into whatever space there is between the exterior of the nipple and the bore of passageway 156.

Figure 7A:
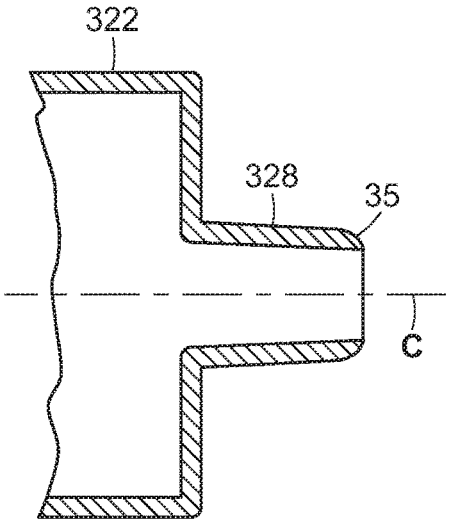
FIG. 7A is a partial lengthwise cross section of a sleeve showing a chamfer at the tip of a nipple.
Figure 7B:
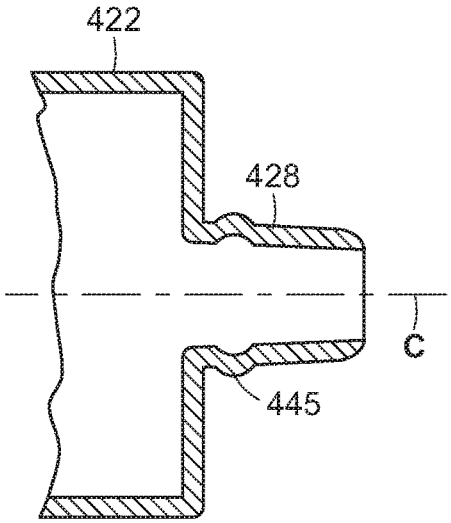
FIG. 7B is a view like FIG. 7A, showing an alternate embodiment sleeve.

During manufacturing of a casing, sleeve nipple 128 is placed into passageway 130 of the base and is flared radially outwardly to engage shoulder 144, as indicated by the phantom and arrow D in FIG. 7, to form lip 134. Preferably, as shown in FIG. 7A, the tip of the nipple is heavily chamfered prior to insertion of the nipple into the passageway of a base. Alternatively, the tip may be thinned by chamfering within the bore of the nipple. The chamfering and forming processes result in a lip that decreases in thickness in the outward direction, i.e., with radial distance from the centerline C. See FIG. 7C. FIG. 7D and FIG. 7E are detail cross sections showing the lengthwise cross sections of a portion of the nipple and the shape of lip embodiments. Lip 34 has a surface 77 which is continuously curved. Lip 434 has a surface 277 which has curved inner and outer portions separated by a flat that runs perpendicular to length axis C.

In the invention, when the sleeve is viewed in lengthwise cross section, a preferred lip has a curved surface portion on the lip surface that faces in the direction of the end of the base which has the recess for a primer. The opposing side of the lip sealingly sets on a shoulder in the passageway of the base. Restated, a preferred sleeve has a lip that is thinner at the lip rim or outer edge than at the place where the nipple commences to run down the passageway of the base, in combination with a surface which is wholly or partially curved. An advantage of the thinner outer edge and the curved second surface will be appreciated below in the description related to FIG. 15.

A preferred sleeve comprises a nipple which is particularly amenable to being flared with the desired shape and sealing effect. The chamfering of the nipple tip or terminal end and the stretching during flaring achieve the desired configuration. As described below, an effective seal is also a result of choice of preferred material and fabricating process, which result in differential properties along the length of the nipple within a base. In particular, preferably the tip of the nipple is softer than the rest of the sleeve, which has a desired combination of high hardness, high strength, and magnetic character.

Figure 14:
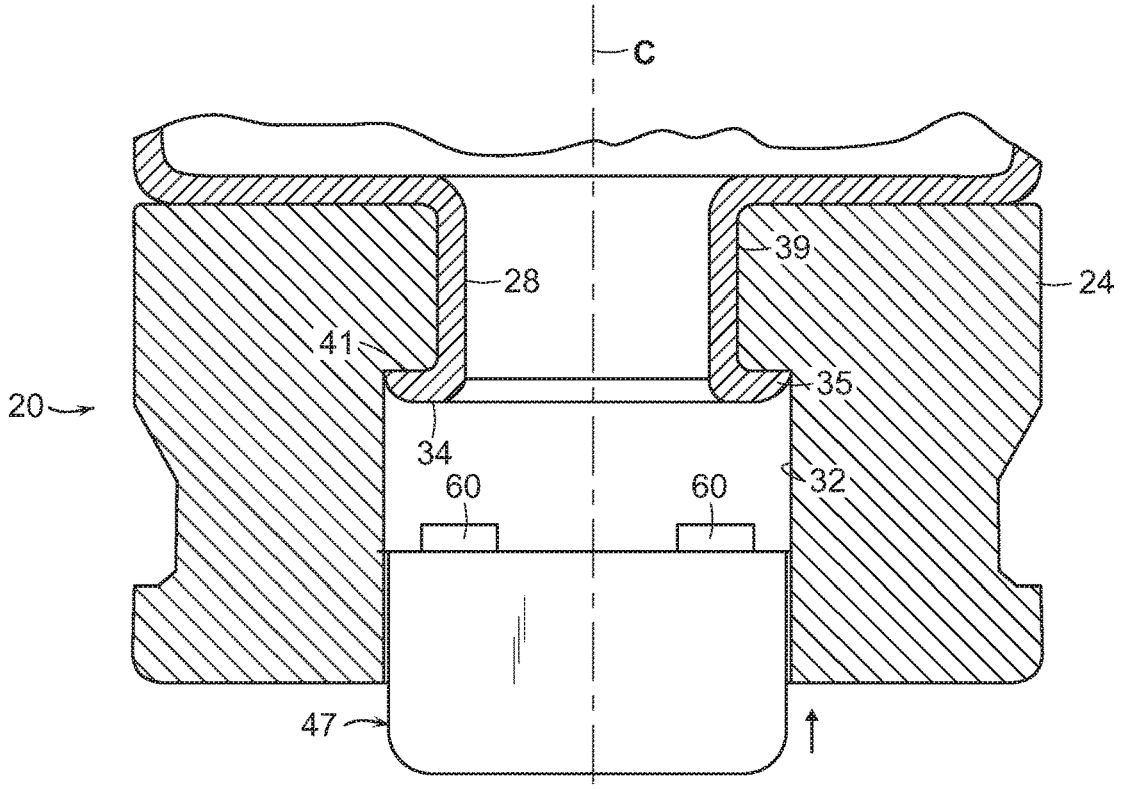
FIG. 14 is partial cross section of a base of a casing showing how a primer is press fitted into the recess of the base.
Figure 15:
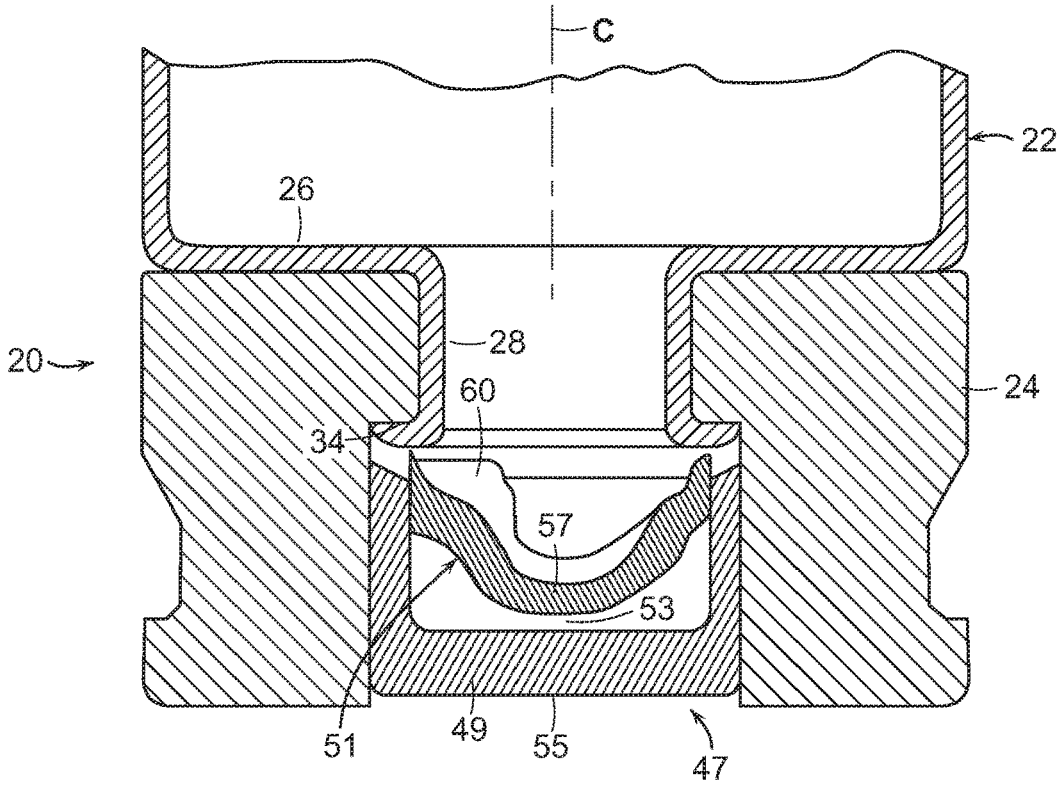
FIG. 15 is a view like FIG. 14 showing a primer inserted into the recess of a base.

As described below in connection with FIG. 14 and FIG. 15, in a subsequent manufacturing step, a primer is press fitted into recess 132, which has a chamfer 142 to ease such placement. The primer has an internal anvil, the feet of which rest on the lip of the sleeve.

While the shoulder onto which the lip is flared is preferably at 90 degrees to the length axis of the base and casing, in alternative embodiments the shoulder be frusto-conical shaped. In such instance, a thin-rim lip may present as a surface that is 90 degrees to the length axis. In a further alternate embodiment of the invention, the lip has a substantially constant thickness. To carry out this embodiment, when first formed, the nipple may have little or no chamfer at its terminal end, and during the flaring or lip-forming process the material at the end of the nipple is gathered and otherwise worked appropriately by one or more forming tools.

In an embodiment of the invention, a nipple may slip into the passageway 156 and there is only a first seal associated with lip 134. Preferably, there is a second seal between the nipple and the base within the bore of passageway 156, more preferably in proximity to the bulkhead.

Figure 7C:
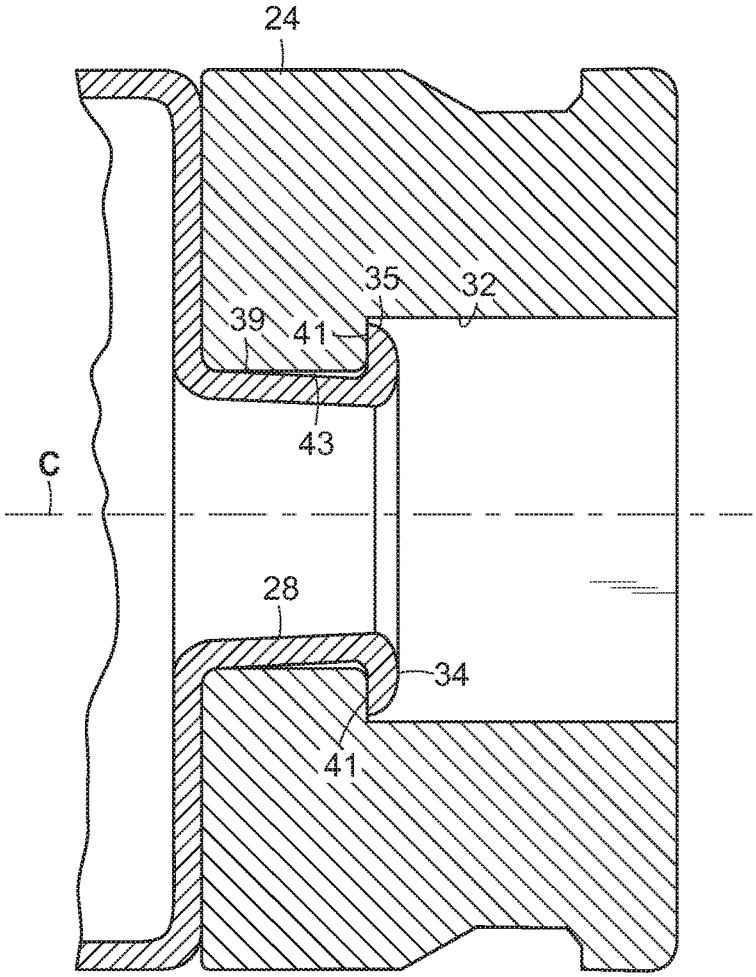
FIG. 7C is a partial lengthwise cross section of a sleeve within a base, showing the seal regions.
Figure 7D:
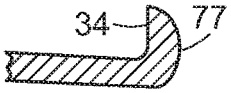
FIG. 7D is a lengthwise cross section of a portion of the lip of a nipple of a sleeve.
Figure 7E:
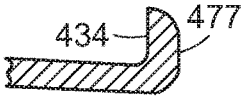
FIG. 7E is like FIG. 7D, showing an alternative configuration lip.

FIG. 7C shows a portion of a casing having the desirable first and second seals. The first seal 41 runs circularly between lip 34 and the shoulder of the base. The second seal at location 39 is substantially cylindrical. When a tapered nipple or a nipple relating to the nipple shown in FIG. 7B is pressed into the passageway, and the terminal end of the nipple is flared, the casing is characterized by a very thin void space 43, i.e., a region where there has not been a jamming of one surface into another. The space 43, which is exaggerated greatly in size for purpose of illustration circumscribes the nipple near the first seal, and tends to have the shape of a tapered-wall thin-wall-cylinder. Having a void 43 ensures that a good seal is achieved at location 39, and helps ensure that when pressed into the passageway of a base, the end of the nipple will be located correctly and can be appropriately formed, to make a lip 34.

In one way of constructing a casing having the two spaced apart seals, passageway 156 is of constant diameter and the exterior of the nipple is tapered. With reference to sleeve 222 in FIG. 9, the outside surface of nipple 228 tapers inwardly with distance from bulkhead 126, at angle B. Angle B is between 0 degrees and 10 degrees, preferably between 1 to 3 degrees. The diameter of the base of the nipple (nearest the bulkhead) is sized relative to the opening of passageway 156 at surface 136 so there is an interference or press fit of 0.002 to 0.005 inches (0.05 to 0.13 mm).

FIG. 7B shows alternative sleeve embodiment 422, which has a circumscribing ridge 445 on nipple 428, the aim of which is to enhance accomplishing the formation of the second seal 39. When inserted into the passageway, the ridge has an interference fit with the bore of the passageway. Nipple 428 may alternatively be tapered or substantially constant in outside diameter. In still other sleeve embodiments, the nipple may have step-changes in diameter along the nipple length.

In another embodiment of casing, passageway 156 tapers at angle BB as shown in FIG. 6, so the bore diameter is greater near surface 136 of the base. The nipple used with a base having such a passageway may be substantially constant diameter or may be tapered at the same angle or at a lesser angle than angle BB. In this embodiment, the second seal will be formed by press-fit at a location that is spaced apart from the surface 136 and may be proximate the lip seal.

As mentioned above, in another embodiment of casing where there is no second seal, the relative shapes of the nipple exterior and the bore of passageway 156 may be such that there is no press fit along the length of the nipple, and only the lip at the terminal end. In any of the embodiments, optional use may be made of an organic or inorganic sealant around the nipple or at the lip location.

Figure 11:
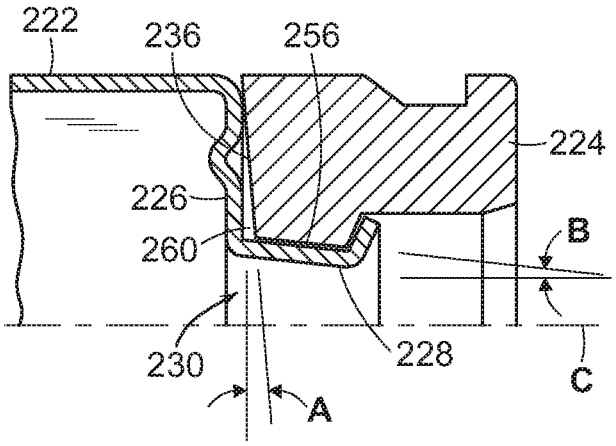
FIG. 11 is a partial cross section of a base and the adjacent sleeve, showing a space in vicinity of the nipple.
Figure 12A:
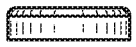
FIG. 12A shows in side view a first stage in progressive formation of a sleeve of a casing.
Figure 12B:
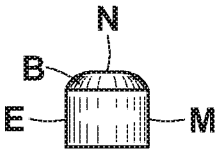
FIG. 12B is like FIG. 12A, showing a second stage.
Figure 12C:
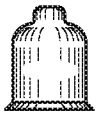
FIG. 12C is like FIG. 12A, showing a third stage.
Figure 12D:
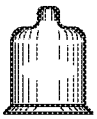
FIG. 12D is like FIG. 12A, showing a fourth stage.
Figure 12E:
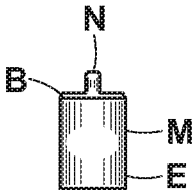
FIG. 12E is like FIG. 12A, showing a fifth stage.

The bore of a nipple may be straight or tapered; preferably the nipple has a wall thickness that is approximately the same as the thickness of the cylindrical section of the sleeve. As shown in FIG. 7 and FIG. 11 the bore of a nipple—which is the flash hole of the casing, increases in diameter with proximity to the bulkhead and the concavity of the sleeve, i.e., in accord with angle B in FIG. 9 where B is between 1 and 5 degrees. Such conical shape is thought to enhance the manner in which hot gases from the primer are delivered to the gunpowder.

Referring again to FIG. 5 through FIG. 8, the bulkhead of sleeve 120 contacts, or is in close proximity to, the surface 136 of the base. Base surface 136 may be planar and perpendicular to length axis C of the casing and base. Alternatively, surface 136 may be conical, or dished, so it is depressed near the center of the base, with an incline angle A to plane D (which is a plane that is orthogonal to axis C) of between 0 and 5 degrees, preferably about 3 degrees. See FIG. 6.

In FIG. 6 the outside diameter of the base where it abuts the bulkhead is the same diameter/circumference as the diameter/circumference of the adjacent cylindrical portion of the sleeve. When that is not the case, the outer "edge" or "corner" of the sleeve, namely region 140, 240, may fail due to tensile or bending overload or due to fatigue failure when casings are reloaded. Preferred casing embodiments comprise a base having a face (e.g., surface 236) which is the same diameter as the diameter of the outer edge of the sleeve bulkhead and the portion of its integral sleeve cylindrical wall (e.g., wall 138) that is near the base. Thus, a casing embodiment has a cannelure (extraction groove) which is spaced apart axially from the base second end and the bulkhead by a cylindrical portion of the base and from the planar surface of the first end by a second cylindrical portion, which portion is shaped for gripping by the arm of a chamber-extraction mechanism. In some configurations of casings, the diameter of the second cylindrical portion may be greater than the diameter of the first cylindrical portion. As described below, further support for the sleeve edge can be provided by a curved surface skirt may be provided at the end of the base which mates the bulkhead.

To carry out the purpose just mentioned, and for appearance reasons, there ought to be a minimum gap between the edge or corner 140, 240 and the bulkhead, surface 136. One way of helping to achieve that circumstance is to have an angle A as shown in FIG. 11, between the surface 236 of the base and the mating surface of the bulkhead 226. In the FIG. 11 embodiment, surface of the base is dished at angle A and the surface of adjacent bulkhead lies in plane D which is orthogonal to the central axis C. Thus, the bulkhead is said to be radially angled relative to the surface of the end of the base. That results in a small space 260 between the bulkhead and the surface 236 of the base 224, adjacent the passageway 230.

When a casing of the present invention is fitted with propellant and a bullet and inserted into the chamber of a firearm, it should slip fit into the chamber. For example, the clearance may be a few thousandths of an inch on each side of a typical cartridge having an about 0.386 inch (9.8 mm) outside diameter. During firing of the bullet there is great internal pressure rise which forces the cylindrical wall radially outward against the chamber of the gun. In embodiments of the invention, the casing will elastically deform radially outwardly during the deflagration of the propellant, then elastically to return to near its original dimensions, sufficient to enable easy removal of the spent casing from the chamber of the firearm. However, when there is outward expansion, excess stresses can be created at the circumferential location 140 where the sleeve bulkhead meets the cylindrical wall. It has been discovered through analysis and experiment that a propensity for failure at location 140 is mitigated by either or both (a) making the radius of curvature at location 140 sufficiently small; and (b) providing a circular wave 250, or ridge, on the bulkhead.

With respect to the radius: For a sleeve embodiment having a wall thickness of about 0.012 inch (about 0.3 mm), the mean radius of curvature at location 140 is preferably less than about 0.12 inches (32 mm); more preferably less than about 0.05 inches (1.27 mm). Larger radii make a casing more prone to failure. Still more preferably the radius is about 0.008 inches (0.2 mm) as measured at the inside surface, about 0.020 inches (2 mm) as measured at the outside surface, with a mean radius of about 0.014 inches (0.36 mm). In another preferred embodiment the mean radius is less than about two times the thickness of the material.

Figure 8:
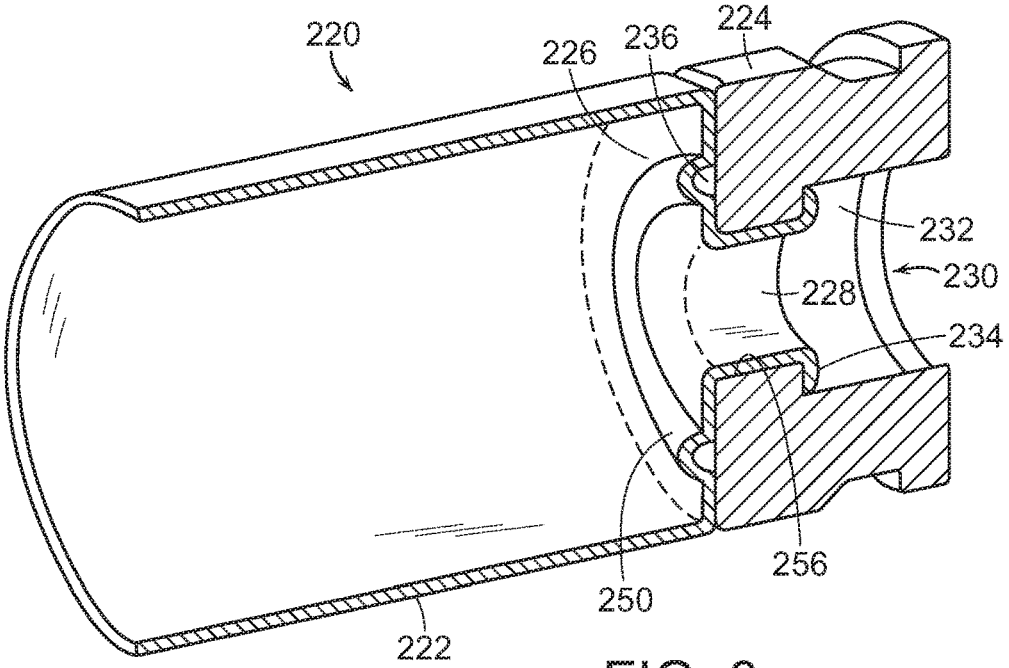
FIG. 8 is a lengthwise cross section through a casing with a sleeve having a circular wave running around the bulkhead
Figure 9:
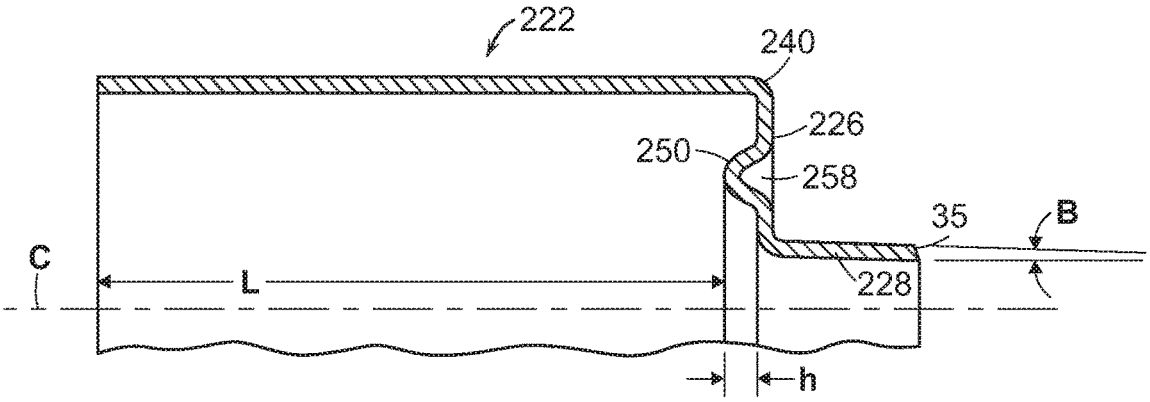
FIG. 9 is a lengthwise cross section of a sleeve having one wave in the bulkhead.

FIG. 8 is a view of casing 220 mated with base 224. Nipple 228 runs lengthwise within the smaller diameter passageway portion 256 of passageway 230 of base 224. The bulkhead 226 of the casing comprises a circular ridge, called a wave here. FIG. 9 is a partial lengthwise cross section of sleeve 222 before it is locked together with the base 224. The Figures show a sleeve 222 and base 224 which are like those of the casing 120, but for the presence of a wave 250 in the bulkhead 226. The circular or annular wave 250 is centered on the length axis C and the nipple length. When viewed in lengthwise cross section as in FIG. 9, wave 250 gives the bulkhead an irregular contour as it runs radially.

A preferred bulkhead has a wave that (a) creates a depression on the exterior side of the bulkhead (that facing the base) and (b) is not restrained by engagement with the abutting surface of the base. The wave defines an annular depression or hollow 258 on the exterior surface of the bulkhead. The bulkhead is preferably of constant thickness and is in contact with or in very close or intimate proximity to the surface 236 at the end of the base; and the wave defines a void space between the bulkhead and the surface 236. When propellant is deflagrated within the casing, the presence of a wave lowers the von Mises stresses at region 240, where the cylindrical sidewall of the sleeve meets the bulkhead. It is believed that the high gas pressure within the casing when gunpowder is ignited causes the wave to elastically deform, or to flatten. That allows both the outside circumferences of the bulkhead and the adjacent sleeve cylindrical portion at location 240 to increase—to the point that they contact the bore of the chamber within which the cartridge is positioned, thereby to make momentarily a seal that inhibits flow of gun barrel gases between the casing and the chamber bore. In the invention, there is no ridge or engagement feature on the base surface, and the bulkhead is able to move radially relative to the surface 236. Preferably the aforementioned small radius of curvature is present at region 240 in combination with a wave.

The void space which the wave creates between the bulkhead and the abutting surface 236 of the end of the base is in addition to whatever small void space may be present in the region because of any difference in angling between the bulkhead and the abutting surface of the base.

In an example of the invention where the sleeve has a wave, the diameter of a 0.010-0.012 inch (0.25-0.30 mm) thick cylindrical wall of a sleeve is about 0.39 inches (9.9 mm) in diameter, a wave 250 will have a mean diameter of about 0.23 inches (5.8 mm) and will project a dimension h of about 0.002 to 0.050 inches (0.05 to 1.27 mm), more preferably about 0.002-0.010 inches (0.051-0.25 mm) from the mean interior surface of the bulkhead. The projection h may be referred to as the height of the wave.

Figure 10:
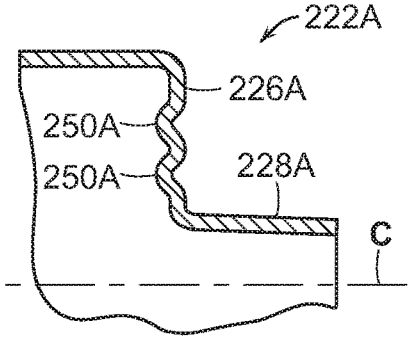
FIG. 10 is a partial lengthwise cross section of a sleeve having two waves in the bulkhead.
Figure 10A:
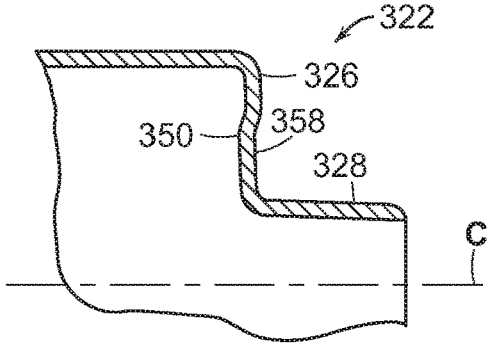
FIG. 10A is lengthwise cross section of a sleeve having an alternative wave.

FIG. 10 shows a portion of a sleeve 222A, which has two waves. Two waves 250A run circularly on bulkhead 226A, circumscribing the length axis C of nipple 228A. FIG. 10A shows a portion of another sleeve 322 having a nipple 328 and bulkhead 326, where there is still another embodiment of wave. In cross section, the depression 358 that is provided by wave 350 starts at the nipple and runs outwardly to a point where the bulkhead surface becomes closer to the abutting surface of the base (not shown in FIG. 10A).

To summarize, in the generality of this aspect of the invention, a casing has a bulkhead with one or more depressions on the surface facing the base. A first bulkhead surface of said wave projects or protrudes into the concavity of the sleeve, and the second opposing side surface of the bulkhead has an associated depression or hollow. Other bulkhead configurations may achieve the object of this aspect of the invention.

Figure 13:
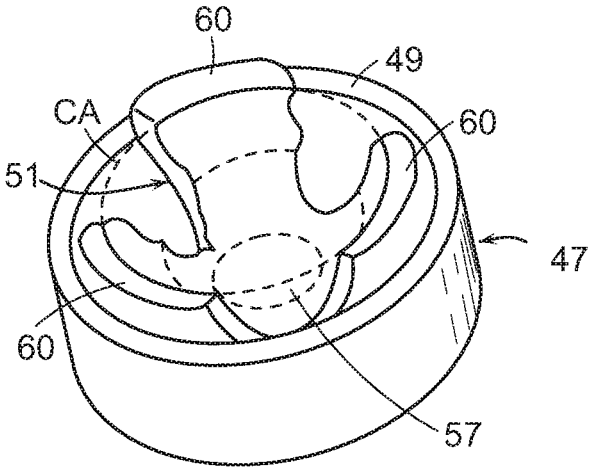
PRIOR ART FIG. 13
FIG. 13 is a perspective view of a primer known in the prior art.

FIG. 13 is a perspective view of a familiar primer 47 comprising cap 49 having an anvil 51 within its concavity. Anvil 51 has a head 57 and three feet 60. There is a circumference CA, shown as a dashed circle, which defines the inner bounds of the feet 60. FIG. 14 shows primer 47 being inserted into the recess 32 of base 24 of casing 20, as indicated by the arrow in the Figure. FIG. 15 shows the cap fully positioned within the recess of the base of the casing. As described above, in a prior manufacturing step the end of nipple 28 of sleeve 22 has been flared outwardly so the resultant lip 34 presents a curved annular surface at the bottom of recess 32. When the primer is fully inserted and when the primer is struck by a firing pin, the feet 60 of the anvil contact the surface of the lip.

The outer edge or rim 35 of lip 34 is thinner than the rest of the lip, as discussed in connection with FIGS. 7C, 7D, and 7E. With reference to FIG. 15, there is a space 53 between head 57 of the anvil and the interior wall of the cap 49, where a quantity of impact-detonating substance (not shown) is placed by the primer manufacturer. When a firing pin of a firearm deforms surface 55 of the cap in the direction of the head 57 of anvil 51, it causes the primer substance to detonate. The anvil feet are supported by lip 34. In response to the applied force, there is a tendency for the anvil legs to thrust outwardly relative to centerline C of the casing. Sectioning of fired cartridges indicates that the feet of many anvils are thrust outwardly to an extent during the firing process. The curved surface of the lip is believed to enhance support for the feet of the anvil.

Figure 16:
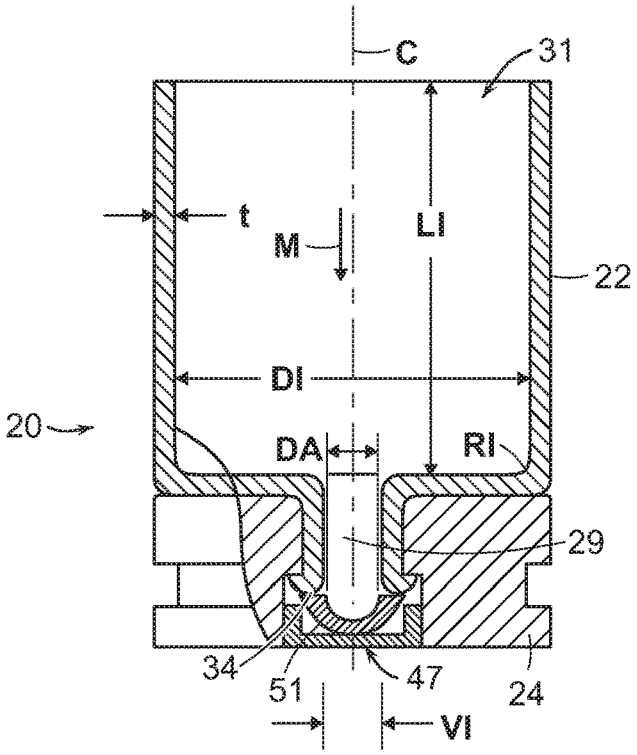
FIG. 16 is a lengthwise cross section of a casing of the present invention.
Figure 17:
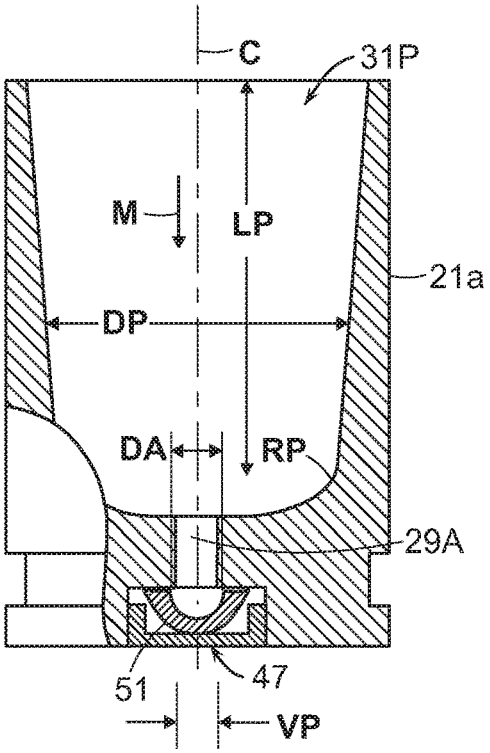
PRIOR ART FIG. 17
FIG. 17 is a lengthwise cross section of a prior art casing.

For a given external shape cartridge, the present invention can provide a larger diameter flash hole larger volume casing, compared to a same exterior shape prior art one piece cartridge. FIG. 16 and FIG. 17 compare the internal configurations of casing 20, made in accord with the present invention and a prior art one piece brass casing 21, each having the same respective length LI, LP of interior cavity.

The invention enables an increased diameter VI of the flash hole 29 in casing 20, compared to diameter VP of flash hole 29A in prior art casing 21, aided by the shape of lip 34 which in providing good support for the feet of the anvil of a primer, enables a smaller width of land at the bottom of the recess 32.

Casing 20 has a flash hole 29 which has increased diameter VI, compared to diameter VP of flash hole 29A in prior art casing 21. The increased diameter is achieved with the aid of the shape of lip 34, which in providing good support for the feet of the anvil of a primer, enables a smaller width of land at the bottom of the recess 32. The flash hole of sleeve 22 is larger in diameter than the diameter DA of the innermost bounds of the anvil feet. Diameter DA is the diameter of a circle CA which touches the innermost portions of the feet 60 of an anvil 51 of a primer. See FIG. 13. In a preferred casing 22 portions of feet 60 are visible to the eye when looking with appropriate magnification along the center axis C, as indicated by the arrow M in FIG. 16. In comparison, only the head of the anvil, and not the edges of the feet, are visible in an exemplary prior art cartridge when viewed in the same way, as portrayed in FIG. 17. An increased diameter flash hole provides improved communication of the hot gases from the primer region, into the concavity 31 of sleeve 22; that aids more favorable deflagration of the gunpowder within the concavity.

Since steels having a higher strength than cartridge brass may be used in a casing of the present invention, thinner casing walls are useful. An exemplary casing of the invention has a nearly uniform wall thickness t of about 0.010 to 0.012 inches (0.25 to 0.3 mm). That is about 0.0.15 inches (0.381 mm) less than the average 0.027 inch (0.59 mm) wall thickness of an exemplary prior art casing 21. Thus the average internal diameter D1 of casing 20 is larger than the average diameter DP of casing 21; and, there may be an about 4 to 15 percent more volume within the casing, for the powder characteristic of an assembled cartridge. Typically a cartridge maker uses a gunpowder which fills the concavity 31, 31P of the casing, when the bullet is in place. In general, to achieve certain desirable pressure vs. time change within the barrel of a gun that enhances bullet velocity and repeatability, it is desirable to have larger volume of reduced burn rate powder, compared to having a smaller volume of high burn rate powder. The present invention enables that desirable result. Tests have shown a higher repeatability in bullet velocity at the exit of the barrel of a gun, and that results in more accurate targeting of the bullet.

In the generality of the invention which involves the foregoing mechanical features, a sleeve may be made of iron alloys (e.g., steels) and preferably other alloys having iron, aluminum, and copper base. As noted just above, the best performance of an invention casing/cartridge is achieved when the material of the sleeve has high strength.

Preferably, an exemplary sleeve of a casing of the present invention is made of a kind of austenitic stainless steel which is cold worked sufficient to form a martensitic microstructure, to thereby selectively both harden and make magnetic the steel, compared to the same steel in its annealed condition. A preferred material for the base is 7075 wrought aluminum alloy in T6 temper.

A preferred austenitic stainless steel is AISI 304 stainless steel alloy. Other alloys which preferentially may be used include AISI 302, AISI 308, AISI 316, and AISI 347. Casings of the foregoing and like-behaving alloys are used in the cold worked condition, without annealing. The select alloys have a desirable combination of formability, corrosion resistance, and strength. In their annealed condition the alloys are not magnetic; when cold worked during casing fabrication they are magnetic. What comprises a magnetic casing is described below in connection with Table 1. In the preferred materials, a deformation-induced martensite (a ferromagnetic phase) is present when the material is cold worked and not-annealed; and that makes the material advantageously attracted by a common magnet. Preferred casing sleeve embodiments are formed of alloys that are in a special class and that are worked in a special way. For example, the austenitic stainless steel, AISI 316, as compared to AISI 304 steel, may not be magnetic when the casing is cold-worked to make a 9 mm casing as described herein. But the casing will be magnetic when AISI 316 steel is worked more severely, such as to form a 7.62 mm casing as described herein, or to form some other casing. In contrast, when casings are made of a stainless steel of the AISI 400 series which is ferritic, the casing will be magnetic regardless of extent of cold working or the presence of martensite.

When casings made of a preferred magnetic austenitic metal are discharged from an automatic or semi-automatic weapon and are scattered about on the ground, the used casings may be retrieved by sweeping an area with a permanent magnet or common electromagnet. Compare, brass, aluminum or non-metal casings cannot be so retrieved.

Working of the AISI 304 alloy also hardens it and increases its ultimate strength, enabling a lighter wall thickness in the sleeve than when the alloy is not cold worked. Preferably, the AISI 304 sleeve material is at least "one-quarter hard", wherein it has a hardness of at least about Rockwell C ("Rc") 30 and an associated ultimate tensile strength of about 125,000 psi (pounds per square inch)($6\times10^6$ N/m$^2$). That compares with the Rockwell B 83-92 hardness and about 75,000 psi ($3.6\times10^6$ N/m$^2$) ultimate tensile strength of a common annealed wrought bar or strip of AISI 304 material. More preferably, AISI 304 material is worked so that the hardness is greater than about Rc 40 and the ultimate tensile strength is in excess of 150,000 psi ($7.2\times10^6$ N/m$^2$).

Preferably, the sleeve is formed in an eyelet machine (transfer press), starting with a flat disk of steel. The disk is sequentially worked to change shape for a 9 mm casing as illustrated by the steps (a) to (e) in FIG. 12. The sleeve in its condition for insertion into the base of a casing is illustrated at step (e). Referring to the illustration at step (e) in FIG. 12, a typical sleeve of the present invention has a top/nipple location N, a bulkhead location B, a midpoint cylindrical section location M, and a mouth end location E, as illustrated in FIG. 12. Working backward through the forming steps, the corresponding locations in the intermediate shapes can be approximately identified.

Table 1 shows the magnetic properties at each stage and the hardness distribution at the final stage (e). It is seen that with progressive working, the permeability (loosely "the magnetization") increased, measured in Mu. Likewise, it is seen that hardness increased significantly at midpoint M and the mouth end E. The hardness in HVN (Vickers Hardness Number using a 200 gm load) is highest at the mouth end, being more than 400 HVN. As is well known, increased hardness is associated with increased yield/ultimate strength, and that property is desirable where the sleeve wall has higher stresses, namely at the cylindrical portion, compared to the nipple.

Preferably, the sleeve of an invention casing is an austenitic stainless steel having a permeability which is at least 2 Mu, more preferably at least 3 Mu. In this application, a steel having such at least 2 Mu property is said to be magnetic. Casings comprised of a sleeve in such magnetic condition can be attracted by a permanent magnet or electromagnet; that is quite useful for purposes of retrieving and/or handling used casings.

The degree of magnetism, namely permeability (more properly relative permeability), of a casing can be measured in Mu units in accord with standard ASTM A342-Method No. 6. Use may be made of a measuring device called The Severn Gage (Severn Engineering Co., Inc., Auburn, Ala., U.S.).

TABLE 1

Local magnetic and hardness properties of sleeve illustrated in FIG. 12.

| Parameter | Stage of formation | N - nipple | B - bulkhead | M - midpoint | E - open end |
|---|---|---|---|---|---|
| Permeability (Mu) | a - near-blank | <1.0 | 1.0-1.1 | | |
| | b | <1.0 | 1.0-1.1 | 1.5 | |
| | c | 1.0-1.1 | 1.0-1.1 | 1.8-2 | 2-3 |
| | d | 1.0-1.1 | 1.1-1.2 | 2-3 | 2-3 |
| | e - finished | 1.4-1.8 | 2-3 | 3-4 | 3-4 |
| Hardness (HVN) | e | 360-390 | 330-350 | 410-440 | 440-490 |

The cylindrical portion E of the sleeve, which extends to the mouth becomes most hard and correspondingly magnetic. The bulkhead also is strong and magnetic. In comparison, the nipple portion of the sleeve is desirably less worked and less hardened and that facilitates its press fit engagement with the base and its capturing within the base by means of a lip. The small diameter of the nipple means stresses for any given internal pressure are lower than in the cylindrical portion of the sleeve. Also, being small and buried within the base, a nipple would contribute little to attraction of a casing to a magnetic pickup tool. Since it is less hard, the nipple terminal end more amenable to being flared radially outwardly and the desired good sealing contact may be better achieved. Cold-working to make the flared lip increases hardness and permeability of the lip portion, but does not change the corresponding properties of the lengthwise nipple portion that runs toward the bulkhead from the lip within passageway 156, 256, in particular, that portion which is in vicinity of void 43 in FIG. 7C.

Thus an embodiment of casing and sleeve is a combination which comprises a sleeve having less permeability and hardness in the nipple where it runs from the lip and the shoulder of the primer recess to the bulkhead that does the sleeve have in at the bulkhead and mouth end.

The base may be formed by stamping, pressing, or machining, less preferably by casting. The base is preferably made of wrought aluminum alloy, preferably alloy wrought 7075 alloy in T6 temper condition. That alloy is of high strength, sufficient to hold the primer and sufficient to endure the forces of the manufacturing process during which the nipple is deformed. An aluminum base may be anodized and dyed for color coding, to demark different types of cartridges. Alternatively, an aluminum alloy base may be coated with electroless nickel phosphorous metal. An exemplary aluminum alloy base will have a Rockwell B hardness in the range 70 to 98. The base has strength sufficient to sustain deforming of the nipple and forces imposed by the breech block. In still another alternative, the base is made of a steel alloy, such as AISI 304 or AISI 316 or a low carbon steel.

In a concept of the present invention, the sleeve cylindrical portion including the mouth has the highest strength and hardness, the bulk of the nipple with the passageway of the base has lesser strength and hardness, and the base has the lowest hardness. This combination is advantageous for reasons in part stated above, and further because the softer base lessens wear or decreased life of the firearm parts which grip and eject cartridges/casings, compared for instance to a steel base, or to a prior art steel casing.

In the generality of the invention, a base may alternatively be made of other metal, such as cartridge brass, other brasses, and cast zinc base alloys, which metals may be less hard than the sleeve material. In still other embodiments of the invention, iron alloys or ceramics may be used for the base. A steel (iron alloy) is described below.

Figure 18:
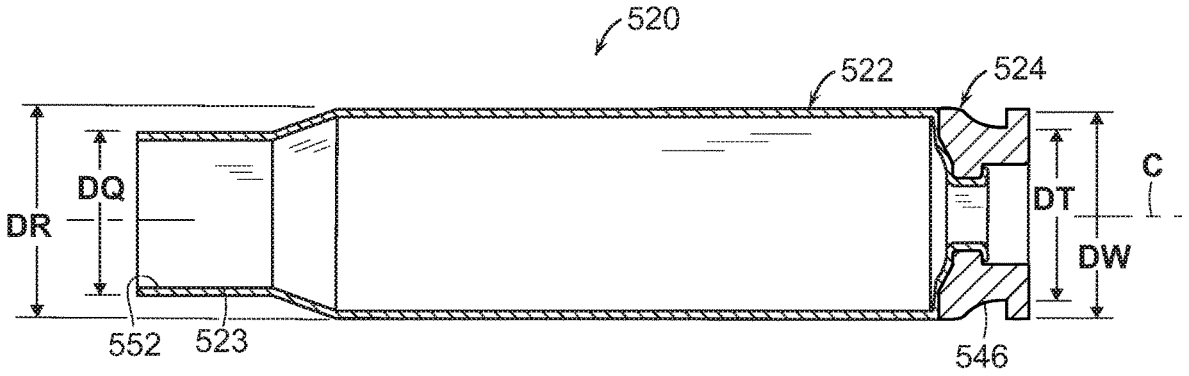
FIG. 18 is a lengthwise cross section view of a casing suited for use as part of rifle ammunition.

FIG. 18 shows an exemplary casing 520 comprised of sleeve 522 and base 524 that has a shape characteristic of a NATO 7.62X51 mm round. The sleeve of the casing may have a cylindrical portion with an outside diameter DR of about 0.467 inch (about 11.9 mm) and a smaller dimension portion 523. The mouth 552 has a nominal diameter of 0.3075 inch (about 7.8 mm). All dimensions recited herein for exemplary articles are basic or nominal dimensions and will have tolerances familiar to the artisan.

A casing 520 is made in essentially the same way as previously described, with the addition of a "cone-forming" step, wherein after the straight cylindrical wall section at the mouth end is formed, its outer end is reduced in diameter by inward deformation to create portion 523.

The pressure of gas within the casing during firing of a bullet of a typical NATO 7.62X51 round is substantially higher than the pressure associated with firing a bullet from a 9 mm round, with which the description above was principally concerned. When an experimental NATO 7.62X51 casing is configured consistent with the arrangement of bulkhead and base surface shown in FIGS. 8 and 9 for a 9 mm casing, the sleeve can be prone to failure in vicinity of outer edge 240, notwithstanding the presence of a useful wave in the sleeve bulkhead. While such failure might be avoided by increasing the overall thickness of the sleeve, doing that is undesirable because casing weight is increased—and weight can be critical to the user in certain kinds of rounds. Using possible other stronger materials can introduce machinability, fabricability and cost issues.

Furthermore, as is commonly the situation, when the casing is used in rounds that are fired from a high speed repeating fire arm, the casing is pulled out of the chamber by an extraction mechanism that comprises a single arm grip. The pulling force of the grip may be high because the expanded sleeve wall of the casing may not have relaxed from being expanded, given a high rate of firing. The grip can produce a significant eccentric force on the base, urging it to cant relative to the centerline C and the length axis of the nipple; and as a result there may be some unwanted permanent deformation and small separation of the sleeve/bulkhead outer edge and mating base outer surface.

Figure 19:
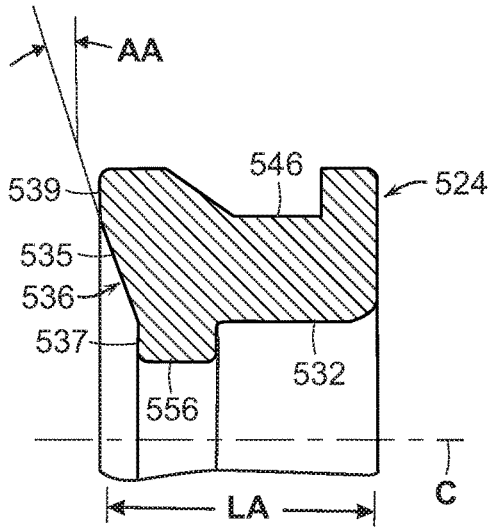
FIG. 19 is a partial lengthwise cross section of a base comprising a conical portion and two spaced apart annular portions.
Figure 20:
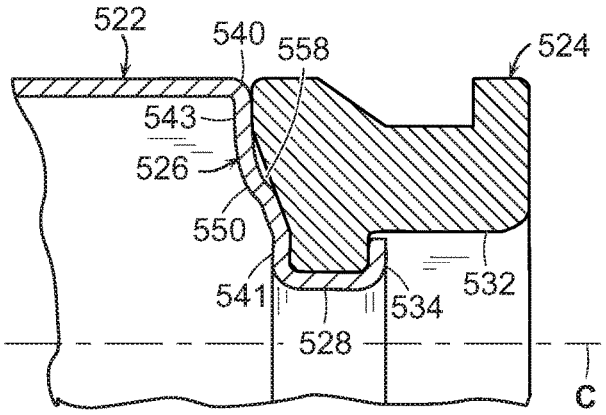
FIG. 20 is a partial lengthwise cross section of the base of FIG. 19 along with a portion of an attached sleeve which has a mating bulkhead, with a wave in the bulkhead.

The embodiment of casing 520 that is illustrated by FIG. 18 to FIG. 20 provides a useful article wherein base 524 has a recess 532 at the end of passageway 556 within which nipple 528 of sleeve 522 is held in place by lip 534, in accord with casings described above. There is a circumscribing cannelure 546, which is described in more detail below along with invention embodiments.

Surface 536 of the distal or second end of base 524 (that end which faces bulkhead 526 of sleeve 522) preferably has a contour that lessens the chances of failure under high deflagration pressures. Surface 536 comprises, nearest the passageway 556, inner annular flat portion 537; next, in the radially-outward direction is conical section 535; next, outer annular flat portion 539. Portion 539 terminates at a radially-outer base edge that is chamfered. The annular portions 537, 539 are preferably substantially perpendicular to the lengthwise axis C; alternative embodiments may have slight incline angles. The conical surface 535 has an angle AA of preferably 18 degrees to a plane perpendicular to the length axis C. In other embodiments angle AA may range from 5 to 25 degrees. (Conical surface 535 and any mating conical surface of the bulkhead are simply referred to as "conical" though they are technically frusto-conical sections.) In other embodiments of the invention the conical surface 535 may be curved in the lengthwise axis direction instead of being straight as pictured, and within the scope of claims that configuration should be characterized as a conical section.

Bulkhead 526 generally fits intimately with or contacts base distal surface 536, but for the presence of a wave 550. Bulkhead 526 comprises an inner annular portion 541 that mates with base surface 537; an outer annular portion 543 that mates with base surface 539; and a conical portion that connects the annular portions and mates with base surface 535. The smaller diameter end of the bulkhead conical portion projects lengthwise away from the direction of mouth end of the sleeve and fits the conical surface portion 536 of the base, except where preferred wave 550 provides a circular depression in the bulkhead surface which faces base distal surface 536. Wave 550 defines, with the surface 536 of the second end of the base, void space 558. The wave has function and benefit like those waves previously described. There may be more than one wave, also as previously described. In other embodiments there may be no wave. It is felt that an advantage of having the annular portions attending the conical portion of the bulkhead is that it gives better assurance that the shape and thus the fit of the cone will not be compromised because of the curvature of the bulkhead where it transitions to either the cylindrical sleeve portion or the nipple. In casing embodiments where there may be different needs, the base second end (and the mating bulkhead) may have only one or none of an inner annular surface and an outer annular surface.

Consistent with what has been recited above, a NATO 7.62X51 cartridge may comprise a bulkhead with wave that mates with a base distal end surface that nominally is perpendicular to the lengthwise axis C, i.e., like the casings shown in FIG. 8 and FIG. 9

Experiments show improved performance with respect to containing high deflagration pressures for casing embodiments having features like those shown in FIG. 19 through FIG. 20. The combination of mating conical surfaces and wave lessen the tendency for fracture at bulkhead outer edge 540 (also referred to as the sleeve outer edge), where the bulkhead integrally connects with the cylindrical portion of the sleeve. The combination of features also improves resistance to any casing-extraction-caused bending of a sleeve in vicinity of the nipple, which bending could result in a gap in vicinity of edge 540. Base 524 of FIG. 19 has a length LA of 0.237 inch (6 mm), whereas if the distal end was planar-perpendicular of the type shown in FIG. 8), the length would be 0.210 inch (5.3 mm). That places the edge of the sleeve/bulkhead desirably further within the chamber of a firearm. Accordingly, it makes the sleeve slightly shorter. But since there is added volume at the conical region of the bulkhead, the net negative effect on gunpowder volume within the sleeve is very small.

Figure 22:
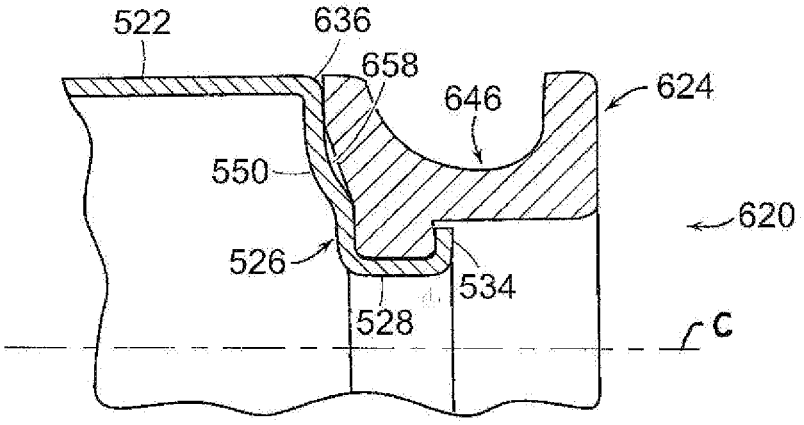
FIG. 22 is a partial lengthwise cross section of a base like that of FIG. 21 along with a portion of an attached sleeve, where the bulkhead and abutting base face are conical but lack annular portions.
Figure 23:
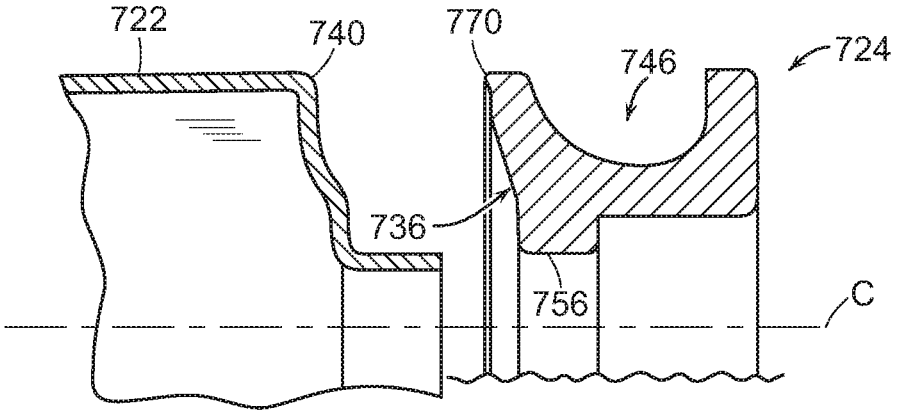
FIG. 23 is a partial lengthwise cross section of a base having a skirt at the distal end, along with a sleeve positioned for lengthwise movement so the nipple goes into the base passageway.
Figure 24:
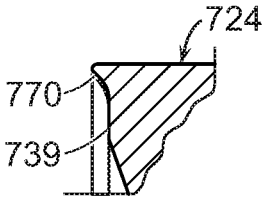
FIG. 24 is a more detail view of the edge portion of the base of FIG. 23.

FIG. 23 shows base 724 in combination with sleeve 722, which is positioned for nipple-insertion into the base passageway. Base 724 has a passageway 756 and cannelure 746. The shape of base 724 is like that of base 624 except for an added feature, namely skirt 770. When assembled the components shown in FIG. 23 form an article very much like the article in FIG. 22. Skirt 770 runs around the outer edge, or the rim, of base distal end surface 736. As shown in the view of FIG. 24, skirt 770 is a thin member which a very narrow (but blunt) tip, for example the radial width of the tip might be about 0.006 inch (0.15 mm).

The inward facing curving surface of skirt 770 is shaped to mate with the curved edge 740 of sleeve 722. See FIG. 23. In a cross section view, curve surface of the skirt fades into the outer annular surface 739 of base 724. Thus the skirt provides support to the sleeve at the edge 740, and aids structurally in resisting deflagration pressure. A skirt like skirt 770 may be used in casings which comprise other embodiments of base, including a base like on those shown in connection with the 9 mm casing example, where there is no conical portion at the distal end and the base has a prior art style cannelure.

With any of the base-to-sleeve configurations described above, the case forming process described in connection with FIG. 12A to FIG. 12E may be adjusted to increase the thickness of metal locally in the region 540. Doing such is difficult and only about 10 percent thickness increase might be achieved.

A further casing improvement relates to the size and shape of the base of the casing and its cannelure feature. Referring again to casing 520, the circumscribing cannelure 546 which is shown in FIGS. 18 to 20 is in accord with cannelures which characterize prior art brass casings. Cannelure 546 has a planar annular portion that runs perpendicular to the length axis C of the casing and that comprises the inner surface of the flange at the proximal end of the base/casing. The annular surface is contacted by a grip arm of the firearm extraction mechanism when the casing is pulled from a chamber. Cannelure 546 further comprises a cylindrical surface that runs lengthwise from the annular portion. The cylindrical portion has a diameter DT and can be referred to as the groove-bottom of the cannelure. The cannelure surface then runs outwardly on a conical angle from the groove-bottom to a cylindrical surface having diameter DW, which is the diameter of the sleeve 522. The conical portion enables good disengagement of a casing from an extraction grip arm as the casing is caused to fly away from the breech region.

Figure 21:
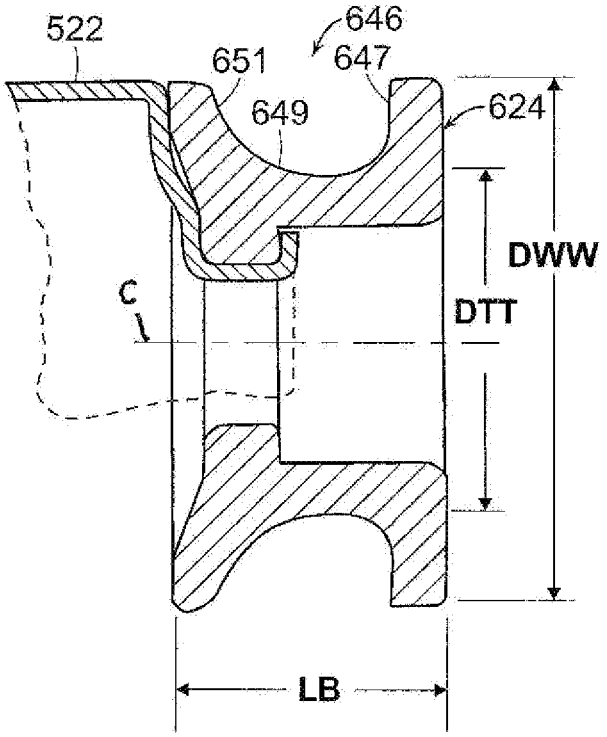
FIG. 21 is a partial lengthwise cross section of a base having a large volume cannelure.

FIG. 21 shows in cross section base 624 which has a conical portion distal end that is advantageously used with sleeve 522 (partially shown in phantom). Cannelure 646 of base 624 has, compared to prior art cannelure 546, a greater groove depth (i.e., it has a smaller diameter DTT at the place where the cannelure surface is closest to the central lengthwise axis). And the cannelure 646 has substantially greater volume than prior art cannelure 546 of base 524. That increased volume reduces the weight of the base and of the casing as a whole. But having less material in the base results in higher unit stresses within the material of the base. Thus, such a cannelure would not be useful in a 7.62X51X round of present interest, if the base material was not sufficiently strong. For instance, where there are high deflagration pressures, a type of brass used in prior art 7.62X51X one piece casings or the type of aluminum alloy mentioned above can be insufficiently strong. A casing base 624 having a cannelure 646 preferably comprises material which has substantially higher tensile strength, as described below.

A casing embodiment of the present invention is characterized by a cannelure that, in lengthwise centerline cross section of the base, has a mostly continuous curve shape. That compares with a prior art cannelure defined by only cylindrical and frusto-conical surfaces. Cannelure 646 in FIG. 21 and cannelure 746 in FIG. 23 are embodiments of the invention. The portion of the cannelure surface which is nearest to the first/proximal end of the base (which is the end having the primer recess) is an annular surface 647 that is planar-perpendicular to the length axis C of the base (and thus also, to the length axis of the casing). With reference to FIG. 21, from that annular portion surface 647, the cannelure surface curvedly runs inwardly, then curvingly runs lengthwise at region 649, and then curvingly runs outwardly at region 651 to a cylindrical portion of the base which has a diameter the same as the outside diameter DWW of an associated sleeve 522. The cylindrical portion runs lengthwise from region 651 to intersect with the base distal surface (e.g., surface 536 in FIG. 19). The continuous curve of an invention cannelure may be comprised of a plurality of slightly different frusto-conical portions that approximate the preferred smooth curve.

Experiments have shown that only when the cannelure is shaped as just described is the necessary good strength and functionality obtained in a casing. The base volume is reduced, making feasible the use of a heavy-but-strong alloy (e.g. an iron alloy) compared to a copper base alloy or a light metal alloy (e.g. an aluminum alloy). When the size of the cannelure is increased and diameter of the cannelure is reduced, as described below, that makes feasible a process wherein a base is formed from highly machinable but not-so-strong steel and the base is thereafter strengthened.

A prior art configuration of cannelure 546 for a NATO 7.62X51 casing has a 0.469 inch (1.19 mm) outside diameter DW and a 0.403 inch (1.02 mm) diameter DT of the deepest portion of the cylindrical surface or groove-bottom. See FIG. 18. Diameter DT is about 86 percent of diameter DW and the volume of the cannelure is about 0.0046 cubic inches (0.075 cubic mm) or about 15 percent of the volume of the about 0.03 cubic inch (0.51 cu mm) volume of a hypothetical same-size base which lacks any cannelure.

In this description, a "same-size base" is a hypothetical base which has the same dimensions as an exemplary base, but for the absence of a cannelure. The volume of a cannelure is the volume of an imaginary solid having an interior surface with the shape of the cannelure and an outside cylindrical surface, the diameter of which is that of the base portion near the sleeve where there is no cannelure surface. That cannelure volume is fractionally compared to the volume of a hypothetical same-size base. If a base has a flange portion with an outside diameter greater than the diameter of the sleeve, such greater diameter flange portion would be ignored in any parametric comparison.

In an exemplary base 624 of the present invention, the outside diameter DWW is about 0.469 inch and the deepest groove portion diameter DTT is about 0.300 inch (7.6 mm). See FIG. 21. Thus the diameter DTT is about 64 percent of the diameter DWW. The volume of the cannelure is nominally 0.013 cubic inch (0.22 cu mm), which is about 43 percent of the volume of a same-size base having no cannelure. The size of a cannelure which is useful in a particular base/casing is a function of the deflagration pressure and pressure profile, the strength of the material of the base, and the acceptable amount, if any, of permanent deformation.

Presently, experiments have been carried out with casing with bases made of steel material having an estimated yield strength of 120,000 to 140,000 pounds per square inch (about 827,000 to 965,000 kiloNewtons per square meter (kN/sq m)). The bases have been formed by the methods described below.

A cannelure embodiment of the present invention has a diameter DTT that is between about 60 to about 80 percent of diameter DWW and a volume that is between about 20 and about 43 percent of a same-size base having no cannelure. An invention embodiment cannelure may have as much as about 3 times greater volume than a cannelure having the size taught by the prior art for a NATO 7.62X51 casing. The invention cannelure may be used in bases of other size firearm rounds and in bases made of other materials than the kind of material preferred for a NATO 7.62X51 round; and may be used in bases which have a second/distal end surface which is other than conical.

To recapitulate, in embodiments of the present invention, a two piece casing comprises a base having a cannelure which comprises one or more of:

- a surface having an innermost or groove-depth diameter DTT which is between about 60 and about 80 percent of the outside diameter DWW of the base;
- a volume which is between about 20 and about 43 percent of the volume of a like-base which has no cannelure; and,
- a continuously curving surface that extends from an annular grip surface portion near the base first end to a cylindrical portion near the base second end.

And embodiments of the invention comprise a two-piece casing comprised of a base and associated sleeve bulkhead, each having mating dished or conical portions, preferably with one or both an inner annular portion and an outer annular portion; and an optional wave.

The features of the FIG. 19 to FIG. 21 embodiments of casing may be used in making other styles of cartridges or rounds, particularly where high deflagration pressures are expected. And the features may be used with casings having bases which are made of aluminum alloy or other metal alloy, in addition to a steel alloy.

A NATO 7.62X51 round is preferably made of an iron alloy, compared to an aluminum alloy which has been described above for 9 mm casings. An iron alloy has a benefit of being resistant to errant metal ignition. For machinability, bases may be machined from AISI 12L14 steel (a commercial leaded steel having up to about 0.15 weight percent carbon) or another low carbon steel. Such steels lack sufficient carbon to be significant hardenable by heat treatment. Higher carbon steel or alloy steels which are hardenable could be used for their high strengths, but such metals have a disadvantage of comparatively low machinability, raising cost of fabrication. Bases will typically be machined from bar stock using an automatic screw machine.

In a manufacturing method of the present invention, there is a desirable synergy and criticality in making a base from a high machinability low carbon steel, forming a large cannelure like that described above to reduce section thickness, and then diffusing carbon into the metal of the base (carburizing), and then heat treating the base. Optionally, there may also be plating or other surface protection provided in the finished product.

Normally, carburizing (typically heating to diffuse carbon from active agents placed in proximity the surface of a metal part) is thought of as being useful for imparting surface hardness and wear resistance to a component, while retaining ductility and toughness in the core region. Since casings most often have a onetime use (and even if they are reloaded, they have limited number of re-uses), there would not be good reason to provide surface hardness to the base of a casing—the amount of wear being minimal.

In the present invention, the large cannelure and resultant small metal thicknesses in a base enable the carburizing process to be employed to convert the material of the base into a material which is responsive to heat treatment and resultant raising of tensile strength. And otherwise insufficient strength base material is thus converted into one that has strength sufficient to resist failure under the high pressures and forces associated with deflagration of gunpowder.

In the invention, carburizing attains a desirable concentration of carbon—an exemplary aim being about 0.4-0.5 weight percent carbon in the surface regions and near surface regions—which concentration is sufficient to enabling subsequent heat treatment, hardening, and strength increase. Thus a base with an exemplary large volume and deep depth cannelure is able to resist the forces of deflagration. In an exemplary practice of the invention, carbon diffuses to a depth of about 0.020 to about 0.040 inch (0.5 to 1.1 mm). Carbon diffuses into the base structure from the internal passageway as well. As a result of having the passageway and deep cannelure, a large fraction of the base is able to have sufficient carbon addition to be strengthened by heat treating. The surface diffusion process which characterizes carburizing provides a carbon concentration gradient, with the highest amount of carbon at the surface and the near-surface regions, and the least amount of carbon at portions most distant from any surface. After carburizing, followed by austentizing, followed by quenching, an exemplary base within which the metal is AISI 12L14 steel or another low carbon steel will have in the surface and near-surface regions a hardness of about 30-35 Rockwell C and an associated yield strength estimated at 120,000 to 140,000 pounds per square inch (about 827,000 to 965,000 kN/sq m). In interior portions distant from a surface, the hardness may be 20 Rockwell C.

The present invention includes a round (also called a shell or a cartridge) which comprises a casing having the new features which are described herein. In particular, a round is formed by pressing into place a primer in the recess of the base of casing, putting gunpowder into the concavity of the sleeve through the mouth end, and pressing and crimping a bullet into the mouth of the sleeve.

The present invention also includes the method of making a casing and a cartridge having the features described herein using the methods which have been described. A casing may be assembled from a sleeve and base by using automated machinery which mates the two pieces with each other and using (a) tooling that fits within the mouth of the sleeve and presses on the nipple and adjacent bulkhead while the base is being held, to force the nipple into the passageway of the base so the outer edge of the sleeve/bulkhead is either in contact with the face of the base or intimately close; and using (b) tooling that fits within the primer recess and presses axially on the terminal end of the nipple to flare the end radially outwardly and form a lip which presses against the shoulder at the bottom of the recess, where the lip preferably has an annular curved surface. Thereafter, to form a cartridge, in step (c) a primer is pressed into the recess at the end of the base so the legs of the primer anvil contact or are very close to the surface of the lip; in step (d) gunpowder is put into the concavity of the sleeve; and in step (e) a bullet is pressed into the mouth of the sleeve and the mouth is preferably crimped onto the bullet. When the casing is intended for a full powered casing such as a NATO 7.62×51 mm round, the sleeve portion near the sleeve mouth will be "coned" so there is a reduced diameter cylindrical portion, preferably after the foregoing step (a).

The unique features of the sleeve and base provide the invention with surprising advantage. A casing/cartridge is provided with a desirable combination of lower weight, lower cost and higher performance than prior art casings. At the same time the casings/cartridges generally have durability during handling and the capability for reloading. While the invention has been described in terms of small caliber cartridges, the invention may be applied to large caliber shells.

The invention, with explicit and implicit variations and advantages, has been described and illustrated with respect to several embodiments. Those embodiments should be considered illustrative and not restrictive. Any use of words which relate to the orientation of an article pictured in space are for facilitating comprehension and should not be limiting should an article be oriented differently. Any use of words such as "preferred" and variations thereof suggest a feature or combination which is desirable, but which is not necessarily mandatory. Thus, embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A casing for a firearm cartridge, comprising:
- a sleeve having
- a concavity, a length, a central lengthwise axis,
- a first end having a mouth for receiving a bullet,
- a second end having a cylindrical wall portion, a bulkhead running radially inwardly from the cylindrical wall portion, and a nipple having a bore connected to the concavity, extending lengthwise from the bulkhead;
- a base having a first end, a second end, a length, a central lengthwise axis, and a central passageway running lengthwise between the first end of the base and the second end of the base, wherein the second end of the base is in mating contact with the sleeve bulkhead and the nipple of the sleeve is within the passageway of the base;
- the first end of the base comprising a flange having a first cylindrical exterior surface;
- the second end of the base comprising a second cylindrical exterior surface that is adjacent the bulkhead of the sleeve,
- a cannelure, situated between said first and second cylindrical exterior surfaces, characterized by
  - an annular planar surface of the flange that faces in the direction of the second end of the base and runs radially inwardly toward said central lengthwise axis of the base from the first cylindrical exterior surface,
  - a first cannelure circumscribing surface, contiguous with said annular planar surface, running both curvingly inwardly in the direction of said central lengthwise axis of the base and lengthwise toward the second end of the base and,
  - a second cannelure circumscribing surface, contiguous with said first cannelure circumscribing surface, running both curvingly away from said central lengthwise axis of the base and lengthwise to said second cylindrical exterior surface.

2. The casing of claim 1, wherein at least one of said cannelure circumscribing surfaces at closest proximity to said central lengthwise axis of the base, has a diameter between about 60 and 80 percent of the outside diameter of said second cylindrical exterior surface of the base.

3. The casing of claim 1 wherein the cannelure has a volume which is between about 20 percent and about 43 percent of the volume of a base that is like said base but which has no cannelure, wherein the volume of the cannelure is volume of the space bounded by the said annular planar surface, said first cannelure circumscribing surface, said second cannelure circumscribing surfaces and an imaginary cylindrical surface connecting said first cylindrical exterior surface and said second cylindrical exterior surface.

4. The casing of claim 1 wherein a portion of said second cannelure circumscribing surface is closer to the central lengthwise axis than any portion of said first cannelure circumscribing surface.

5. The casing of claim 1 further comprising a skirt contiguous with the second cylindrical exterior surface at the second end of the base, for mating with the bulkhead outer edge.

6. The casing of claim 1 wherein said bulkhead of the sleeve comprises at least one wave circumscribing said nipple.

7. The casing of claim 1 wherein the sleeve is made of steel material.

8. The casing of claim 7 wherein the sleeve is made of austenitic stainless steel material.

9. A cartridge comprising the casing of claim 1 in combination with a primer positioned within a portion of the central passageway proximate the first end of the base, a quantity of gunpowder within said concavity of the sleeve, and a bullet positioned within the mouth of the sleeve.

10. A casing for a firearm cartridge, comprising:
- a sleeve having
- a concavity, a length, a central lengthwise axis,
- a first end having a mouth for receiving a bullet,
- a second end having a cylindrical wall portion,
- a bulkhead running transverse to said central lengthwise axis, integrally connected to the cylindrical wall portion, and
- a nipple, having a bore connected to said concavity, extending lengthwise from the bulkhead, wherein the bulkhead comprises at least one wave which encircles the nipple; and,
- a base having
- a length and an associated central lengthwise axis,
- a first end comprising a flange having a first cylindrical exterior surface,
- a second end, shaped for mating with the bulkhead of the sleeve, having a surface which is either a frusto-conical surface or an annular surface running approximately perpendicular to said central lengthwise axis of the base,
- a central passageway running lengthwise between the first end of the base and the second end of the base,
- a second cylindrical exterior surface at the second end of the base,
- a cannelure, situated between said first cylindrical exterior surface and the second cylindrical exterior surface, characterized by
  - a first cannelure surface portion that is annular and planar, running radially from said first cylindrical exterior surface toward the central lengthwise axis of the base to a first diameter of the base;
  - a second cannelure surface portion that circumscribes the central lengthwise axis of the base and runs curvingly lengthwise from said first cannelure surface portion toward the second end of the base, the second surface portion comprising a sub-portion having a second diameter that is less than the first diameter of the base;

a third cannelure surface portion that circumscribes the central lengthwise axis of the base and runs curvingly lengthwise to said second cylindrical exterior surface;

wherein the bulkhead is in abutting contact with said base second end; and wherein said nipple of the sleeve is positioned and secured within said passageway of the base.

11. The casing of claim 10 wherein at least one of said cannelure surface portions, at closest proximity to the central lengthwise axis of the base, has a diameter between about 60 and 80 percent of the diameter of the outside diameter of said second cylindrical portion of the base.

12. The casing of claim 10 wherein the cannelure has a volume which is between about 20 percent and about 43 percent of the volume of a base that is like said base but which has no cannelure, wherein the volume of the cannelure is volume of the space bounded by the first cannelure surface portion, the second cannelure surface portion, the third cannelure surface portion and an imaginary cylindrical surface connecting said first cylindrical exterior surface and said second exterior surface.

13. The casing of claim 10 further comprising a skirt contiguous with the second cylindrical exterior surface at the second end of the base, for mating with the bulkhead outer edge.

14. The casing of claim 10 wherein the sleeve is made of a steel material or an austenitic stainless steel material.

15. The casing of claim 14 wherein the base is made of a steel material.

16. A cartridge comprising the casing of claim 10 in combination with a primer positioned within the central passageway proximate the first end of the base, a quantity of gunpowder within said concavity of the sleeve, and a bullet positioned within the mouth of the sleeve.

* * * * *